US007568440B2

(12) United States Patent
Miyoshi

(10) Patent No.: US 7,568,440 B2
(45) Date of Patent: Aug. 4, 2009

(54) THREADING DEVICE OF SEWING MACHINE

(75) Inventor: Takanao Miyoshi, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 12/120,916

(22) Filed: May 15, 2008

(65) Prior Publication Data

US 2008/0282952 A1 Nov. 20, 2008

(30) Foreign Application Priority Data

May 15, 2007 (JP) ..... 2007-129372

(51) Int. Cl.
*D05B 87/02* (2006.01)
*D05B 87/00* (2006.01)

(52) U.S. Cl. ..... 112/225

(58) Field of Classification Search ..... 112/225, 112/163, 274; 223/99
See application file for complete search history.

(56) References Cited

U.S. PATENT DOCUMENTS 4,876,973 A * 10/1989 Marrache et al. ..... 112/470.13
5,072,678 A * 12/1991 Satoma ..... 112/225
5,195,452 A * 3/1993 Kamiya ..... 112/225
6,067,920 A * 5/2000 Uemoto ..... 112/225
6,907,834 B2 * 6/2005 Noguchi et al. ..... 112/293

FOREIGN PATENT DOCUMENTS

JP 10-137481 5/1998

* cited by examiner

*Primary Examiner*—Ismael Izaguirre
(74) *Attorney, Agent, or Firm*—Drinker Biddle & Reath LLP

(57) ABSTRACT

A threading device includes a threading shaft holding a threading hook, a threading operation inputting mechanism from which a back-and-forth movement is given to the threading hook, a first supporting mechanism movably supporting the threading shaft in an X-axis direction, a second supporting mechanism movably supporting the threading shaft in a Y-axis direction, and a positioning mechanism which, when a movement operating portion is operated, moves the threading shaft along a path corresponding to an arrangement of each of the needles. The positioning mechanism includes a first cam mechanism which moves the threading shaft in the X-axis direction, and a second cam mechanism which moves the threading shaft in the second direction. The threading shaft is sequentially moved to positions corresponding to the arrangement of each of the needles in the horizontal directions in accordance with the operation of the movement operating portion.

3 Claims, 15 Drawing Sheets

THREADING DEVICE OF SEWING MACHINE

CROSS-REFERENCE TO RELATED APPLICATION(S)

The present application claims priority from Japanese Patent Application No. 2007-129372 filed on May 15, 2007, the entire content of which is incorporated herein by reference.

FIELD OF THE INVENTION

The present invention relates to a threading device of a sewing machine which is operable to form a plurality of kinds of stitches.

BACKGROUND ART

In a sewing machine having two needles which are arranged such that eyes of the respective needles are at different heights from a throat plate, there has been known a threading device that is operable to thread each of the eyes of the two needles. Such a threading device may include a threading shaft which is disposed adjacent to a needle bar and having a threading hook at a lower end portion thereof, an turning base which is rotatably supported on a sewing machine frame via a support shaft disposed parallel to the needle bar and supporting the threading shaft so as to be movable in a vertical direction, a threading lever from which a downward moving operation is input to the threading shaft, and a threading guide which determines a height of the threading hook at the time of a threading operation (see, e.g., JP 10-137481 A).

The threading shaft is supported so as to be rotatable and vertically movable with respect to the turning base. The threading hook is disposed at the lower end portion of the threading shaft so as to extend in a circumferential direction around the threading shaft. The threading operation is implemented by rotating the threading shaft in one direction such that the threading hook is inserted through the eye of the one of the needles in order to catch a thread ahead thereof, and by rotating the threading shaft in a reverse direction such that the threading hook is removed out from the eye of the needle in order to pull in the thread through the eye.

The threading lever is formed with an oblique cam groove, while the threading shaft is provided with a follower pin engaging with the cam groove. The threading shaft is further provided with a guide pin which comes into contact with an abutting surface of the threading guide during a downward movement of the threading shaft. Accordingly, when the threading lever is pressed downward, the threading shaft is moved downward together with the threading lever, and then the guide pin of the threading shaft comes into contact with the abutting surface of the threading guide during the downward movement of the threading shaft, whereby the downward movement of the threading shaft becomes restricted. When the threading lever is further operated downward, the follower pin is relatively moved upward with respect to the cam groove so that the threading shaft is rotated with respect to the threading lever, whereby the threading hook is moved forward. At this time, the threading hook is inserted into the eye of either of the needles, and the threading work is carried out.

Meanwhile, the two needles are disposed at different positions, and heights of the eyes of the respective needles are different from each other. In the threading device, however, it is possible to cause the threading hook to pass through a position of each of the needles by changing a position of the threading shaft through a turning operation of the turning base. Furthermore, in order to deal with the difference of the heights between the eyes of the respective needles, the threading guide has two abutting surfaces having different heights so that the guide pin is caused to be in contact with either one of the abutting surfaces corresponding to the position of the threading shaft which has been changed by the turning operation of the turning base.

More specifically, when the threading lever is pressed downward with the turning base being adjusted to a certain angle, the threading shaft is moved downward together with the threading lever, and the guide pin comes into contact with one of the abutting surfaces, whereby the threading shaft is rotated by the interaction between the follower pin and the cam groove so that the threading hook is inserted into the eye of one of the needles to thread the corresponding needle. When the threading lever is pressed downward with the turning base being adjusted to another angle, because the arrangement of the threading shaft is switched, the guide pin comes into contact with the other abutting surface during the downward movement of the threading shaft through the operation of the threading lever, whereby the threading shaft is rotated so that the threading hook is inserted into the eye of the other needle to thread the corresponding needle.

Meanwhile, in recent years, some sewing machines are operable to implement a plurality of kinds of stitches. For example, in a sewing machine operable to implement both an overlock stitch and a cover stitch, five needles are provided. In such a sewing machine having three or more needles, an arrangement of the needles are sometimes complex not only in that heights of respective eyes of the needles are different, but also in that the needles are not arranged in a row, e.g., the needles are arranged so as to be separated in a cloth feeding direction. In such case, it has been difficult to guide the threading hook to each of the needles with the positional adjustment of the threading shaft through the turning operation of the turning base as in the sewing machine described above.

SUMMARY OF THE INVENTION

One or more exemplary embodiments of the present invention provide a sewing machine having at least three needles which are two-dimensionally arranged in horizontal directions, in which a threading hook can be suitably guided to each of the needles.

According to one or more exemplary embodiments of the present invention, a threading device of a sewing machine having at least three needles, which are two-dimensionally arranged in horizontal directions, is provided. The threading device is operable to thread the respective needles. The threading device includes a threading hook operable to insert a thread into an eye of each of the needles by entering the eye by a forward movement and catching the thread by a rearward movement, a threading shaft holding the threading hook, a threading operation inputting mechanism from which a thread inserting movement is given to the threading hook via the threading shaft, a first supporting mechanism supporting the threading shaft so as to be movable in a first direction in a horizontal plane, a second supporting mechanism supporting the threading shaft so as to be movable in a second direction in the horizontal plane, and a positioning mechanism which, when operated, moves the threading shaft along a path corresponding to an arrangement of each of the needles. The positioning mechanism includes a movement operating portion which, when operated, carries out a positional switching toward the respective needles, a first cam mechanism from which a movement in the first direction is given to the threading shaft in accordance with an operation of the movement operating portion, a second cam mechanism from which a movement in the second direction is given to the threading shaft in accordance with the operation of the movement operating portion, and a coupling mechanism operable to combine the movements in the first and second directions from the first and second cam mechanisms and to transmit the combined movements to the threading shaft in accordance with the operation of the movement operating portion. The threading shaft is sequentially moved to positions corresponding to the arrangement of each of the needles in the horizontal directions in accordance with the operation of the movement operating portion.

According to one or more exemplary embodiments of the present invention, the threading device may further include a thread holder operable to hold the thread on a side of the needles opposite to the threading hook, and a frame member to which the thread holder and the threading shaft are attached such that the frame member to which the thread holder are movable together.

According to one or more exemplary embodiments of the present invention, a threading device of a sewing machine having at least three needles, which are two-dimensionally arranged in horizontal directions, is provided. The threading device is operable to thread the respective needles. The threading device includes a threading hook operable to insert a thread into an eye of each of the needles by entering the eye by a forward movement and catching the thread by a rearward movement, a threading shaft which is supported so as to be movable in a vertical direction and rotatable, and holding the threading hook at a lower end portion thereof, an operation lever coupled to the threading shaft so as to be operable to move the threading shaft in the vertical direction, a movement operating portion disposed so as to be manually operable to switch a position of the threading shaft with respect to each of the needles, a first cam which provides, when the movement operating portion is operated, a displacement in a first direction in a horizontal plane to the threading shaft, a second cam which provides, when the movement operating portion is operated, a displacement in a second direction in the horizontal plane to the threading shaft, a first frame member coupled to the first cam so as to be movable in the first direction in the horizontal plane by following the first cam, a second frame member coupled to the second cam so as to move the first frame member in the second direction, which is orthogonal to the first direction in the horizontal plane, by following the second cam, and a coupling mechanism which, when the movement operating portion is operated, combines the displacements in the first and second directions of the first and second frame members from the first and second cams, and transmits the combined displacements to the threading shaft. The threading shaft is sequentially moved to positions corresponding to an arrangement of each of the needles in the horizontal directions.

According to one or more exemplary embodiments of the present invention, the threading shaft is supported by the first supporting mechanism and the second supporting mechanism so as to be movable in the first and second directions in the plane perpendicular to the needles. Therefore, the threading shaft can be moved to any optional positions on the plane. Further, the positioning mechanism includes two cam mechanisms which move the threading shaft in the first and second directions. Therefore, it is possible to sequentially position the threading shaft at positions corresponding to the respective needles on the plane by a cooperation of the cam mechanisms. In other words, even in a case in which there are three or more needles and the needles are not arranged in a simple manner, e.g., not arranged in a line, when seen in a plan view, it is possible to position the threading shaft at positions corresponding to the respective needles in order. Thus, it is possible to accurately perform the threading with respect to the three or more needles.

When the threading shaft is positioned at "the position corresponding to the arrangement of each of the needles", the threading hook can be inserted into the eye of the corresponding one of needles by forwardly moving the threading hook.

Moreover, the first direction and the second direction in the plane perpendicular to the needles are both parallel to the plane perpendicular to the needles, but are not parallel to each other.

According to one or more exemplary embodiments of the present invention, the thread holder and the threading shaft are moved by the same frame member. Therefore, the thread holder can also be suitably positioned with respect to the needles in a similar manner as the threading shaft.

DETAILED DESCRIPTION OF EXEMPLARY EMBODIMENTS

Figure 1:
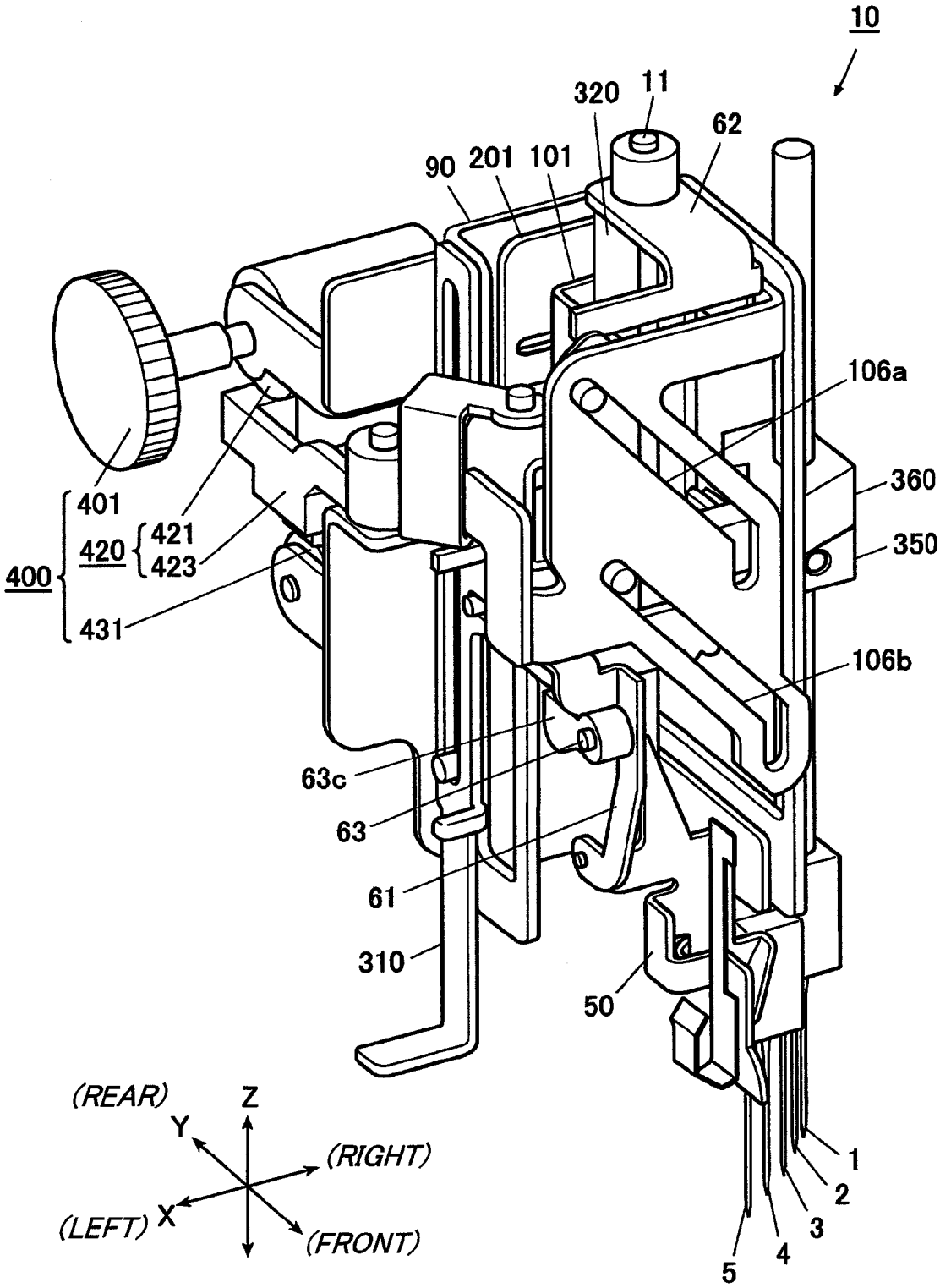
FIG. 1 is a perspective view of a threading device according to an exemplary embodiment of the present invention.

Hereinafter, exemplary embodiments of the present invention will be explained with reference to the drawings. The following exemplary embodiments do not limit the scope of the invention.

A sewing machine according to an exemplary embodiment of the present invention is operable to implement an overlock stitch and a cover stitch, and includes five needles 1 to 5 and a threading device 10. Two needles 1, 2 are used for the overlock stitch and are arranged in a line when seen in a plan view, while the rest of three needles 3, 4, 5 are used in the cover stitch and are also arranged in a line when seen in a plan view. Although the set of needles 1, 2 and the other set of needles 3, 4, 5 are arranged parallel to each other, they are displaced from each other in a direction orthogonal to their arranging direction. The needles 1 to 5 are held by a single needle bar 6.

In the following description, a Z-axis direction (a height direction) is a direction parallel to the needle bar 6, an X-axis direction (a direction orthogonal to a cloth feeding direction, a first direction) is a direction along which the set of needles 1, 2 and the other set of needles 3, 4, 5 are respectively arranged and is orthogonal to the needle bar 6, and a Y-axis direction (the cloth feeding direction, a second direction) is a direction orthogonal to both the needle bar 6 and the X-axis direction.

The threading device 10 is mounted on a surface portion of the sewing machine, and is disposed adjacent to the needle bar 6. The threading device 10 includes a threading hook 20 operable to insert a thread into an eye of each of the needles 1 to 5 by entering the respective eye by a forward movement and by catching the thread by a rearward movement, a threading shaft 11 holding the threading hook, a threading operation inputting mechanism 300 which applies a back-and-forth movement to the threading hook 20 via the threading shaft 11, a thread holder 50 operable to hold the thread on an opposite side of the threading hook 20 with respect to the needles 1 to 5, a thread holder supporting mechanism 60 supporting the thread holder 50 so as to be movable between a threading position, which is on the opposite side of the threading hook 20 with respect to the needles 1 to 5, and a standby position placed apart from the needles 1 to 5, a first supporting mechanism 100 supporting the threading shaft 11 so as to be movable in the X-axis direction (the orthogonal direction to the cloth feeding direction, the first direction), a second supporting mechanism 200 supporting the threading shaft 11 so as to be movable in the Y-axis direction (the cloth feeding direction, the second direction), a positioning mechanism 400 operable to move the threading shaft 11 along a path corresponding to the arrangement of the respective needles 1 to 5 upon an input operation from a moving operation dial 401 (a movement operating portion), and a main frame 90 supporting the respective configurations.

Threading Shaft and Threading Hook

Figure 2:
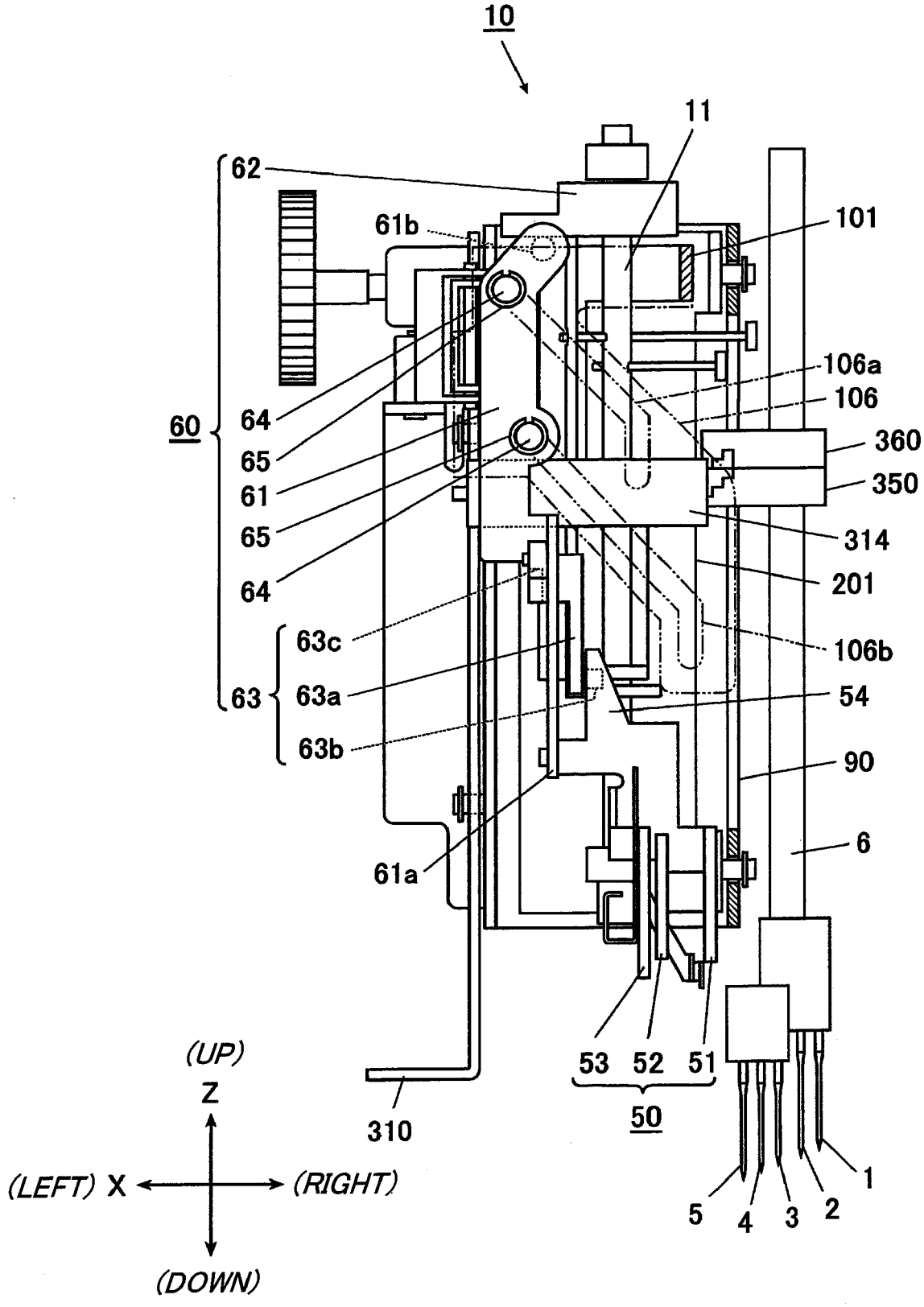
FIG. 2 is a front view of the threading device.

The threading shaft 11 has a shape of a round bar as shown in FIGS. 1 and 2, and is provided movably in the Z-axis direction (a vertical direction) parallel to the needle bar 6 in the vicinity thereof.

Figure 5:
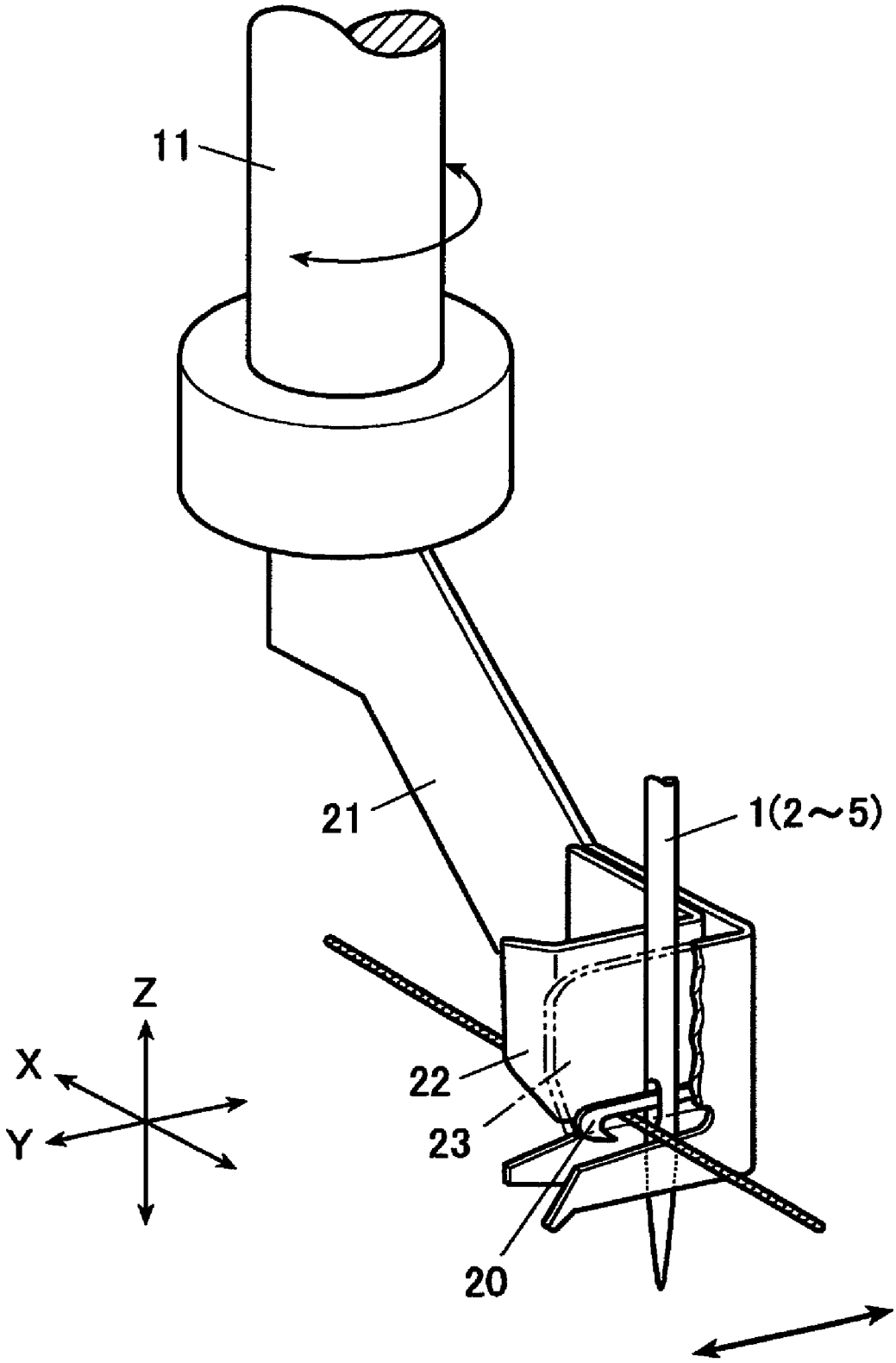
FIG. 5 is an enlarged perspective view of a lower end portion of a threading shaft.
Figure 6:
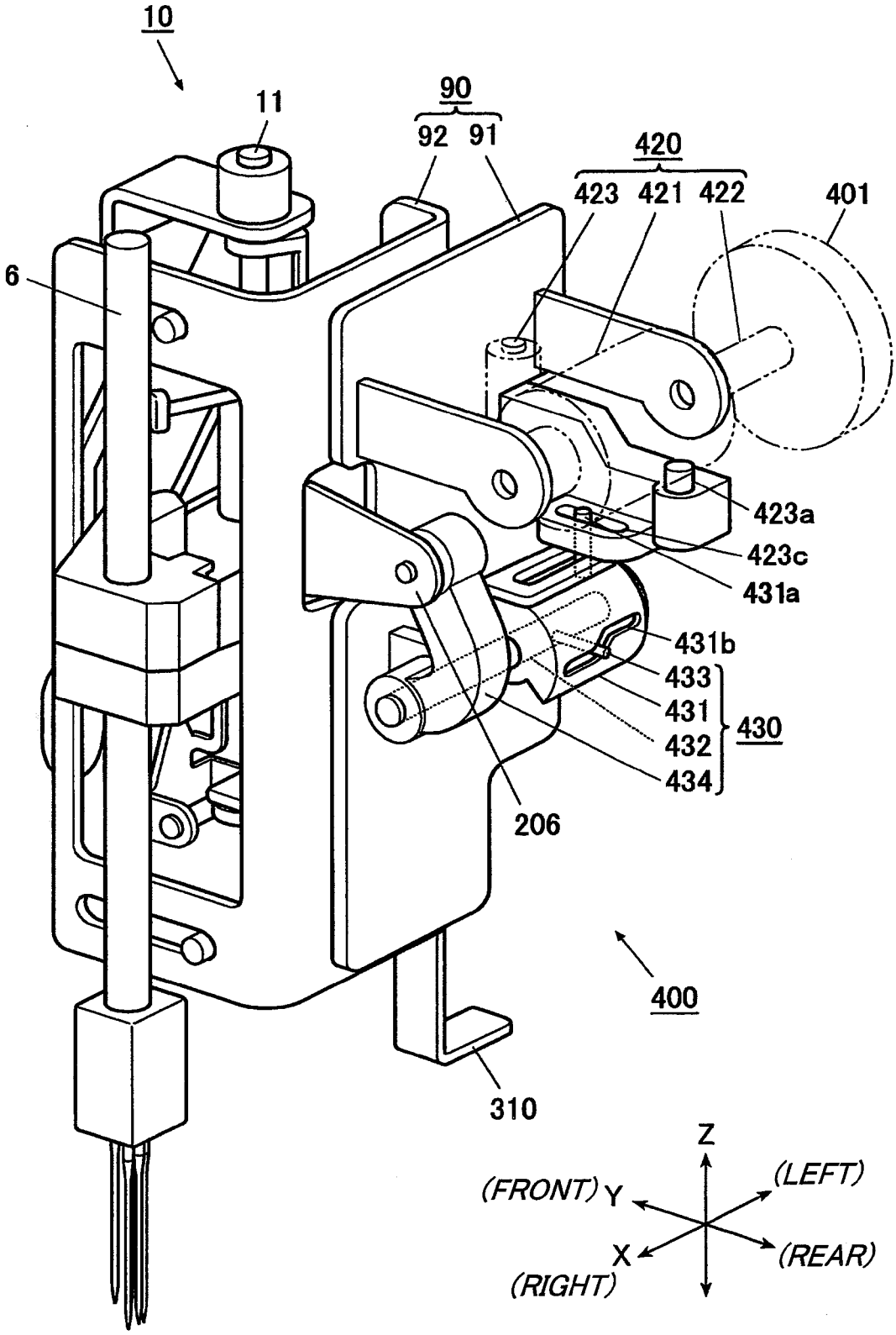
FIG. 6 is another perspective view of the threading device which is seen from a different direction than FIG. 1.

As shown in FIG. 5, the threading hook 20 is provided on a lower end portion of the threading shaft 11 via a hook holding arm 21. The hook holding arm 21 extends downward in a radial direction of a circle around the threading shaft 11.

The threading hook 20 is provided at a tip portion of the hook holding arm 21, and extends in a tangential direction of a circle around the threading shaft 11. Since the threading hook 20 is provided in the tangential direction on a circumference around the threading shaft 11, it is moved forward with a tip portion on a front side by a normal rotation of the threading shaft 11, and is moved rearward by a reverse rotation of the threading shaft 11.

Furthermore, the threading hook 20 has a hook-shaped bent part formed in a tip portion thereof, and is inserted into the eye of any of the needles 1 to 5 from the tip portion in the forward movement and catches the thread through the bent part in the tip portion, and pulls the caught thread into the eye in the rearward movement, thereby executing a threading work.

A pair of guide plates 22, 23 having plate surfaces, which are oriented almost parallel to both the threading hook 20 and the threading shaft 11, are provided on respective sides of the threading hook 20 on the tip portion of the hook holding arm 21. The guide plates 22, 23 are outwardly curved toward respective tip portions, and an interval therebetween is slightly larger than a thickness of an ordinary needle. Through the guide plates 22, 23, it is possible to correctly lead the eye of any of the needles 1 to 5 to the threading hook 20 in the forward movement.

Furthermore, the respective guide plates 22, 23 have thread guiding notches formed in slightly lower positions from the threading hook 20 in a direction of extension of the threading hook 20, and can lead the thread to a proper height in the forward movement, thereby causing the threading hook 20 to catch the thread.

Main Frame

Figure 4:
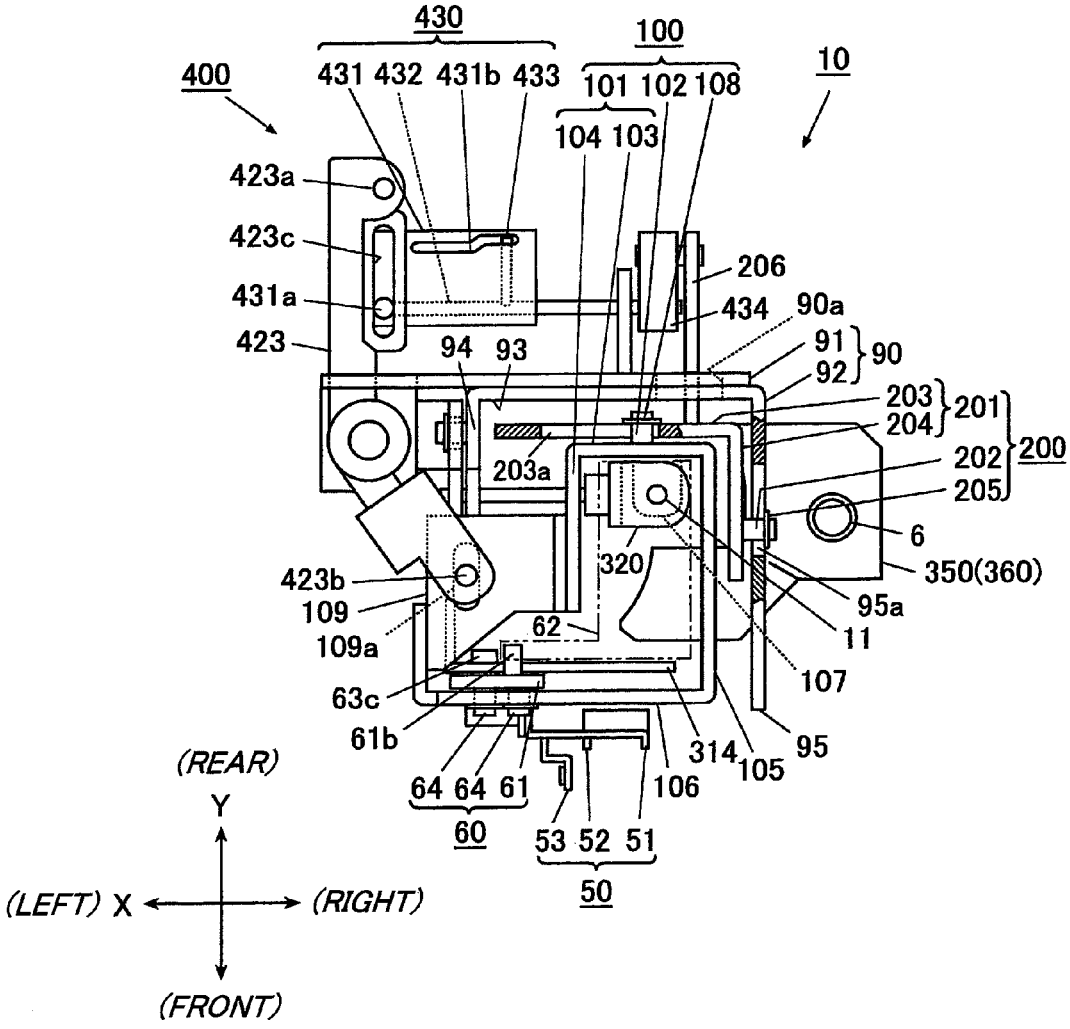
FIG. 4 is a plan view of a portion of the threading device in which some of the components are not shown.

As shown in FIGS. 1 and 4, the main frame 90 is a structure formed through thin plate working and is fixed to a sewing machine frame which is not shown. The main frame 90 includes a back plate 91 which is substantially a flat plate, a front frame member 92 having three sidewall portions as a result of bending. The back plate 91 and the front frame member 92 are fixedly coupled to each other.

The back plate 91 is fixed and supported on the sewing machine frame with a plate surface provided along an X-Z plane, and holds a main structure of the positioning mechanism 400 at a back face side thereof.

The front frame member 92 includes a back sidewall portion 93 provided along the X-Z plane in close contact with a front side of the back plate 91, and left and right sidewall portions 94, 95 bent at right angles from both ends in the X-axis direction of the back sidewall portion and opposed to each other toward a Y-Z plane. In the left and right sidewall portions 94, 95 which are opposed to each other, the left sidewall portion 94 on a sewing machine surface portion side (which will be hereinafter referred to as a left side, and a reverse side thereto will be hereinafter referred to as a right side) has a width in the Y-axis direction set to be considerably smaller than the right sidewall portion 95.

Moreover, the back sidewall portion 93 provided along the X-Z plane has a width in the X-axis direction set to be smaller than the back plate 91, and the back plate 91 is largely protruded leftward with respect to the back sidewall portion 93.

The second supporting mechanism 200 is disposed in a region to be an inside of the front frame member 92, and furthermore, the first supporting mechanism 100 is disposed on an inside of the second supporting mechanism 200.

Second Supporting Mechanism

As shown in FIG. 4, the second supporting mechanism 200 is a structure formed through thin plate working, and includes a second frame member 201 supported movably in the Y-axis direction with respect to the front frame member 92 of the main frame 90 and a guide shaft 202 for coupling the second frame member 201 to the front frame member 92 movably in the Y-axis direction.

The second frame member 201 includes a back sidewall portion 203 opposed to the back sidewall portion 93 of the front frame member 92 and provided along the X-Z plane, and a right sidewall portion 204 bent at a right angle from a right end of the back sidewall portion 203, opposed to the right sidewall portion 95 of the front frame member 92 and provided along the Y-Z plane.

The guide shaft 202 is a cylindrical projection erected at each of upper and lower ends of the right sidewall portion 204, and a slot 95*a* in the Y-axis direction into which each guide shaft 202 is to be inserted is formed in a corresponding position of the right sidewall portion 95 in the front frame member 92. Each slot 95*a* is formed in a width which is almost equal to an outside diameter of each guide shaft 202, and a C ring 205 is attached to a tip portion of the guide shaft 202 and the guide shaft 202 can be prevented from slipping from the slot 95*a*. Two guide shafts 202 are provided side by side in the Y-axis direction at a lower end of the right sidewall portion 204.

The guide shaft 202 is slid along the slot 95*a* so that the second frame member 201 can be moved in the Y-axis direction. In other words, in the second supporting mechanism 200, all of the structures supported by the second frame member 201 can be moved in the Y-axis direction.

Furthermore, a bracket-shaped operation transmitting arm 206 is erected in the Y-axis direction toward the back sidewall portion 93 side at an opposed surface of the back sidewall portion 203 of the second frame member 201 to the back sidewall portion 93. The operation transmitting arm 206 is extended to a back side of the back plate 91 via a through hole 90*a* provided on the main frame 90, and a tip portion thereof is coupled to the positioning mechanism 400 which will be described below.

In other words, a moving force is input in the Y-axis direction from the operation transmitting arm 206 to the second frame member 201.

First Supporting Mechanism

As shown in FIG. 4, the first supporting mechanism 100 is a structure formed through thin plate working, and includes a first frame member 101 supported movably in the X-axis direction with respect to the second frame member 201 of the second support mechanism 200 and a guide shaft 102 for coupling the first frame member 101 to the second frame member 201 movably in the X-axis direction.

The first frame member 101 includes a back sidewall portion 103 opposed to the back sidewall portion 203 of the second frame member 201 and provided along the X-Z plane, two left and right sidewall portions 104 and 105 bent at right angles from both ends of the back sidewall portion 103 and opposed to each other, and a front sidewall portion 106 bent from one of ends of the right sidewall portion 105 and provided along the X-Z plane.

Figure 3:
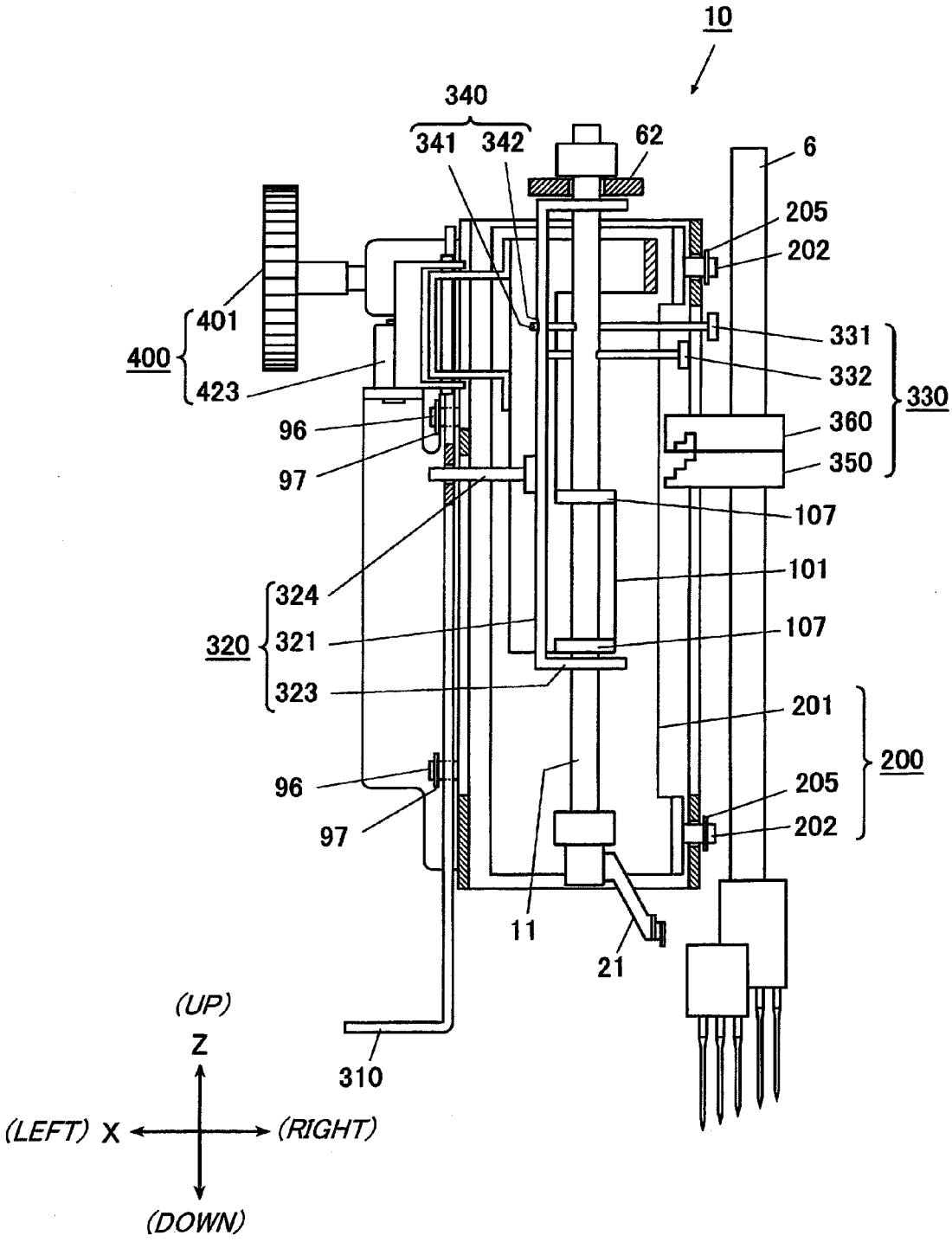
FIG. 3 is another front view of the threading device in which some of the components are not shown.

Two support brackets 107 are arranged vertically at a front side of the back sidewall portion 103 as shown in FIGS. 3 and 4. The respective support brackets 107 are provided with insertion holes for inserting the threading shaft 11 into a concentric position in the Z-axis direction, and the threading shaft 11 is inserted into the insertion holes so that the first frame member 101 supports the threading shaft 11 movably in a vertical direction.

Moreover, the guide shaft 102 is erected at each of the upper and lower ends on a back side of the back sidewall portion 103. The guide shaft 102 is a cylindrical projection and slots 203*a* in the X-axis direction into which the guide shafts 102 are to be inserted are formed in corresponding positions of the back sidewall portion 203 of the second frame member 201. Each of the slots 203*a* is formed in a width which is almost equal to an outside diameter of each of the guide shafts 102, and a C ring 108 is attached to a tip portion of each of the guide shafts 102 so that the guide shaft 102 can be prevented from slipping from the slot 203*a*. Two guide shafts 102 are provided side by side in the X-axis direction at the lower end of the back sidewall portion 103.

The guide shaft 102 is slid along the slot 203*a* so that the first frame member 101 can be moved in the X-axis direction. In other words, the first supporting mechanism 100 can move all of the structures supported by the first frame member 101 with respect to the second frame member 201 in the X-axis direction. In cooperation of the first supporting mechanism 100 with the second supporting mechanism 200, accordingly, all of the structures supported by the first frame member 101 can be optionally moved in both of the X-axis and Y-axis directions with respect to the main frame 90.

A power transmitting bracket 109 taking an almost U shape seen from a front is erected in the X-axis direction on a left side surface of the left sidewall portion 104 as shown in FIG. 4. The operation transmitting bracket 109 has a tip portion coupled to the positioning mechanism 400 which will be described below.

In other words, a moving force is input from the operation transmitting bracket 109 to the first frame member 101 in the X-axis direction.

As shown in FIGS. 1 and 2, the front sidewall portion 106 is provided with guide grooves 106*a*, 106*b* for guiding a movement between a standby position and a threading position of a moving member 61 of the thread holder supporting mechanism 60. The respective guide grooves 106*a*, 106*b* are formed parallel to each other in a rightward and downward direction.

Positioning Mechanism—Overall Configuration

The positioning mechanism 400 will be described with reference to FIGS. 4, 6, 7, 8 and 9.

The positioning mechanism 400 has each structure supported mainly on the back side of the back plate 91 of the main frame 90.

The positioning mechanism 400 includes the moving operation dial 401 for sequentially inputting an operation for switching a position of the threading shaft 11 to each of the needles 1 to 5, a stage switching portion 410 for intermittently dividing a rotating operation of the moving operation dial 401 in order to carry out a stage switching operation for each of the needles 1 to 5, a first cam mechanism 420 for applying a moving operation in the X-axis direction to the threading shaft 11 through the input operation of the moving operation dial 401, and a second cam mechanism 430 for applying a moving operation in the Y-axis direction to the threading shaft 11 through the input operation of the moving operation dial 401.

Positioning Mechanism—Moving Operation Dial and Stage Switching Portion

The moving operation dial 401 is fixed and coupled to one of ends of a first rotating support shaft 422 for fixing and pivotally supporting a first cam 421 of the first cam mechanism 420 in a central position thereof. In other words, it is possible to input a rotating operation to the first cam 421 by rotating the moving operation dial 401.

Figure 8:
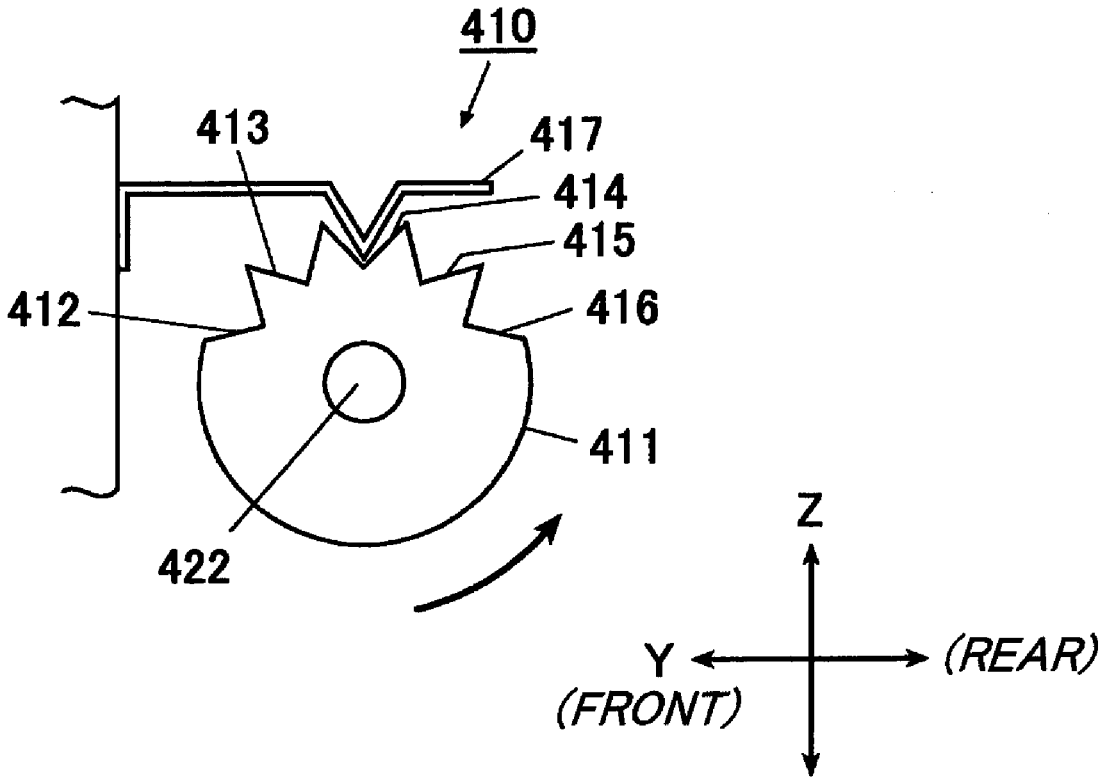
FIG. 8 is a side view of a stage switching portion of a movement operating portion which is seen from a right side.

Moreover, a rotor 411 of the stage switching portion 410 is provided on the other end of the first rotating support shaft 422. More specifically, the stage switching portion 410 includes the rotor 411 fixed and supported on the first rotating support shaft 422 and having, on an outer periphery, engaging concave portions 412 to 416 which individually correspond to the respective needles 1 to 5, and a leaf spring 417 to be fitted in each of the engaging concave portions 412 to 416 to control a rotation of the rotor 411 as shown in FIG. 8.

The leaf spring 417 has an engaging projection formed in a tip portion and is attached to the back plate 91 in such an energizing state that the engaging projection presses the rotor 411. When the moving operation dial 401 is rotated, therefore, the engaging projection enters the respective engaging concave portions 412 to 416 provided on the outer periphery in order so that the rotation is controlled at each time. In other words, the rotating operation is intermittently carried out. An angle interval between the engaging concave portions 412 to 416 is set such that a rotating amount between the engaging concave portions 412 to 416 is set to be an operating amount required for moving the threading shaft 11 between the respective needles 1 to 5.

Positioning Mechanism—First Cam Mechanism The first cam mechanism 420 includes the first rotating support shaft 422 supported rotatably in a turning state in the X-axis direction at the back side of the back plate 91, the first cam 421 (which is not shown in FIG. 4) acting as a groove cam supported to be rotated together with the first rotating support shaft 422, and an oscillating arm 423 having a projection 423*a* acting as a cam follower to be engaged with a cam groove 421*a* formed on an outer periphery of the first cam 421.

Figure 7:
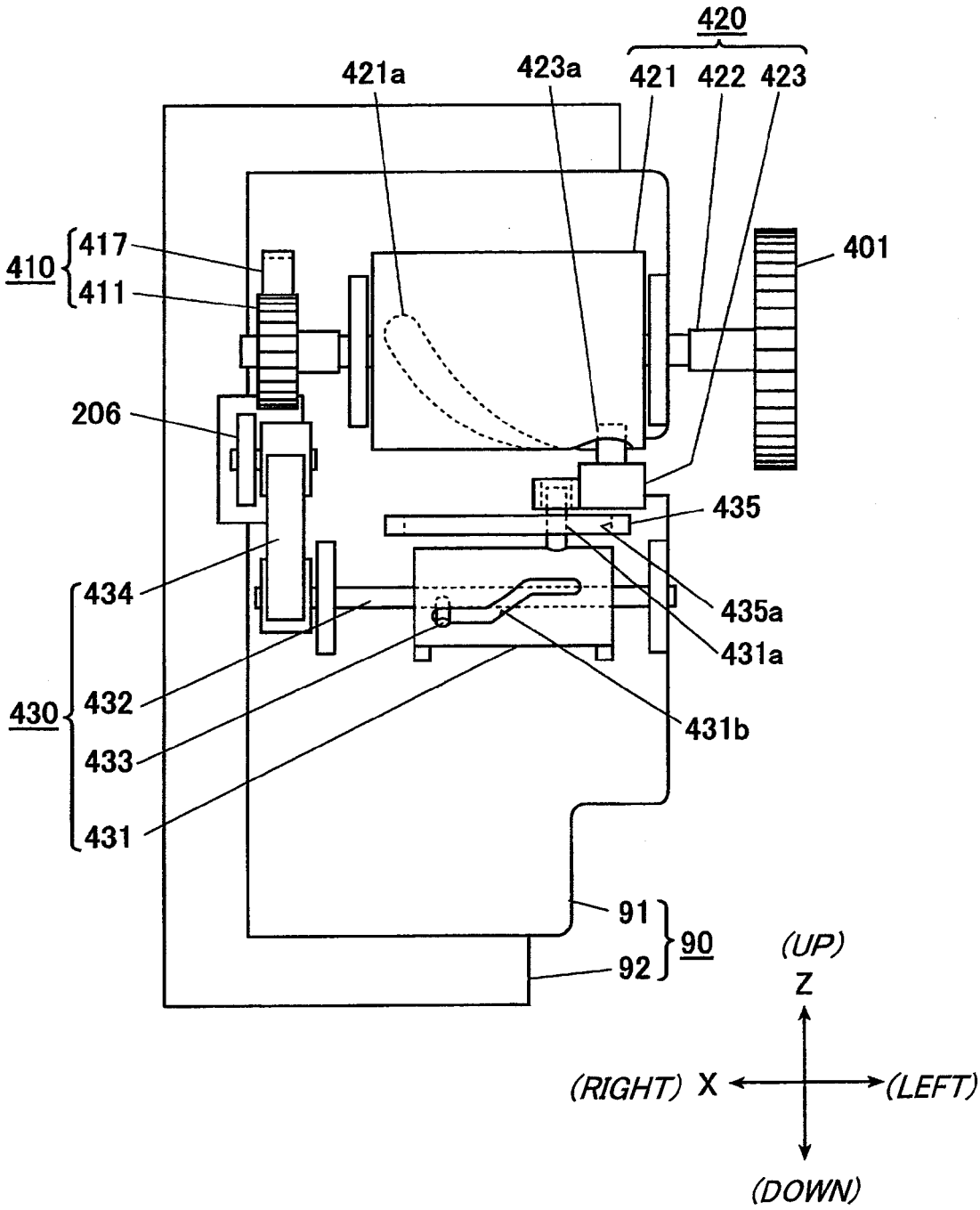
FIG. 7 is a rear view of the threading device in which some of the components are not shown.

The first cam 421 takes a cylindrical shape and has the almost spiral cam groove 421*a* formed on an outer peripheral surface thereof. FIG. 7 shows a state in which the follower projection 423*a* is positioned on one of ends in the cam groove 421*a,* and the threading hook 20 supported on the threading shaft 11 can insert the thread into the needle 1 in that position.

The oscillating arm 423 is coupled to the power transmitting bracket 109 provided on the first frame member 101 through an engaging pin 423*b* provided on the other end. As shown in FIG. 4, the power transmitting bracket 109 has a slot 109*a* formed in the Y-axis direction, and the engaging pin 423*b* of the oscillating arm 423 is inserted in the slot 109*a*.

When the first cam 421 is rotated in a clockwise direction as seen from a left, a moving force in the X-axis direction (a rightward direction) is applied to the follower projection 423*a* of the oscillating arm 423. Consequently, the other end of the oscillating arm 423 generates a leftward movement so that the first frame member 101 is moved in a leftward direction through the power transmitting bracket 109. When the first cam 421 is rotated in a reverse direction, moreover, the first frame member 101 generates a movement in the rightward direction.

The slot 109*a* of the power transmitting bracket 109 serves to permit a displacement in the Y-axis direction which is generated in the rotation of the other end of the oscillating arm 423 and to permit a movement in the Y-axis direction of the first frame member 101 with a movement in the Y-axis direction of the second frame member 201 through the second cam mechanism 430 which will be described below.

Positioning Mechanism—Second Cam Mechanism

The second cam mechanism 430 includes a second cam 431 to be a direct acting cam which carries out a movement in the X-axis direction together with the oscillation of the oscillating arm 423, a second rotating support shaft 432 supported rotatably in a turning state in the X-axis direction at the back side of the back plate 91, a follower projection 433 provided on the rotating support shaft 432 and serving to convert the direct acting operation of the second cam 431 into a rotating operation and to transmit the rotating operation to the second rotating support shaft 432, and an almost L-shaped link member 434 for applying a moving operation in the Y-axis direction to the second frame member 201 through the operation transmitting arm 206 by a rotation of the second rotating support shaft 432.

The second cam 431 has a shape in which a part of an outer peripheral surface of a cylinder having a hollow inner part is taken away and is supported slidably in the X-axis direction through the second rotating support shaft 432 in a state in which the second rotating support shaft 432 is inserted into a center thereof.

Moreover, an engaging projection 431*a* protruded outward is provided on an outer peripheral surface of the second cam 431 and is inserted in a slot 423*c* formed in a longitudinal direction at one end side of the oscillating arm 423. When the oscillating arm 423 is oscillated through the rotation of the first cam 421, consequently, the second cam 431 is moved in the X-axis direction. The reference numeral 435 shown in FIG. 7 is a detent for the second cam 431 on which a slot 435*a* in the X-axis direction is formed. When the engaging projection 431*a* is inserted through the slot 435*a*, a movement in the Y-axis direction of the engaging projection 431*a* is controlled so that the rotation of the second cam 431 is regulated.

Furthermore, the second cam 431 has a slot 431*b* in the X-axis direction formed on an outer peripheral surface thereof, and a tip portion of the follower projection 433 is inserted in the slot 431*b*. The slot 431*b* has a section in which a deformation is partially generated in a circumferential direction in the vicinity of a middle thereof. When the second cam 431 slides along the second rotating support shaft 432 and the follower projection 433 approaches the deforming section, the follower projection 433 is moved in the circumferential direction so that the second rotating support shaft 432 can be rotated.

The link member 434 is pivotally supported on the second rotating support shaft 432 and is rotated together with the second rotating support shaft 432. Moreover, the link member 434 is provided in a turning state in the almost Z-axis direction and a rotating end thereof is coupled to the power transmitting arm 206 extended from the second frame member 201. When the second rotating support shaft 432 and the link member 434 are rotated through the direct action of the second cam 431, accordingly, a moving force in the Y-axis direction is applied to the power transmitting arm 206 so that the second frame member 201 and the first frame member 101 are moved in the Y-axis direction.

Positioning Mechanism—Operation

Next, a moving state to be applied from the cams 421, 431 to respective followers thereof through switching in five stages by means of the moving operation dial 401 will be described with reference to FIG. 9.

Figure 9A:
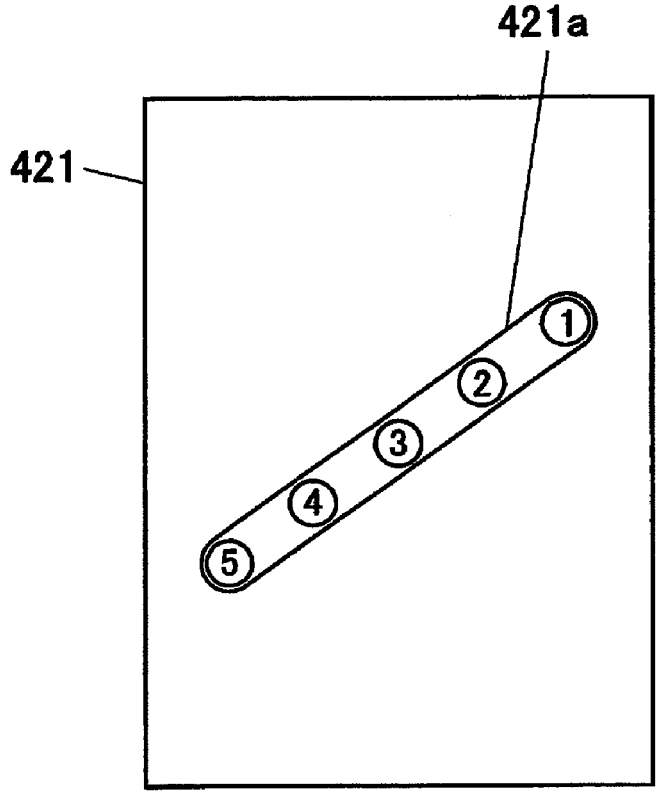
FIG. 9A is an explanatory view showing stage switching positions on a first cam which has been expanded.
Figure 9B:
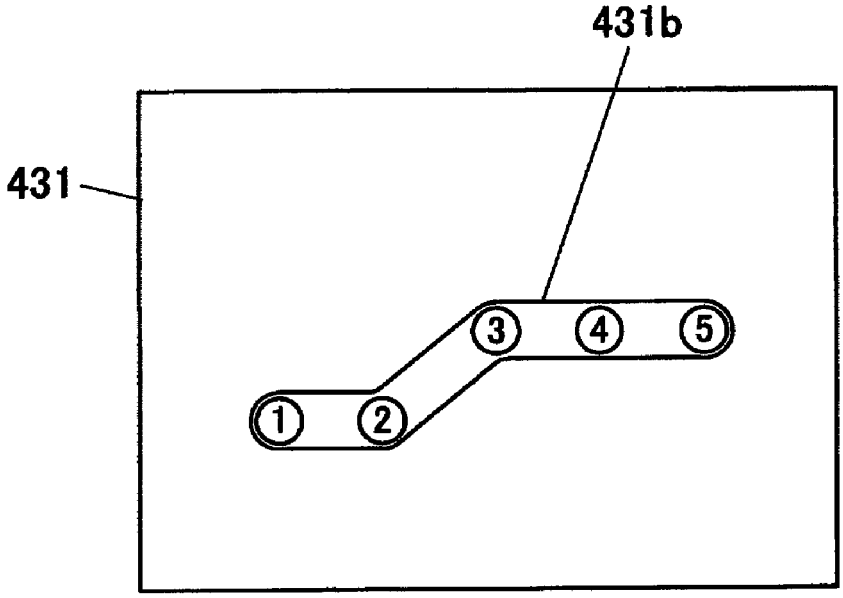
FIG. 9B is an explanatory view showing stage switching positions on a second cam which has been expanded.

(1) In a first state in which the moving operation dial 401 is adjusted to a position at which the engaging projection of the leaf spring 417 engages with the engaging concave portion 412, the projection 423*a* is placed at a first position of FIG. 9A which is one end side of the cam groove 421*a* of the first cam 421, and the first frame member 101 is positioned on a rightmost side. Moreover, the follower projection 433 is placed at a first position of FIG. 9B which is one end of the slot 431*b* of the second cam 431, and the second frame member 201 is positioned on a rearmost side. According to this arrangement of the first and second frame members 101, 201, the threading shaft 11 is placed at a position at which the threading hook 20 carries out a threading with respect to the needle 1.

(2) In a second state in which the moving operation dial 401 is adjusted to a position at which the engaging projection of the leaf spring 417 engages with the engaging concave portion 413, the projection 423*a* is placed at a second position of FIG. 9A in the cam groove 421*a* of the first cam 421, and the first frame member 101 is leftwardly moved. Moreover, the follower projection 433 is placed at a second position of FIG. 9B in the slot 431*b* of the second cam 431, and the second frame member 201 does not move from the first state. A moving distance of the first frame member 101 is coincident with an interval between the needles 1, 2 in the X-axis direction. According to this arrangement of the first and second frame members 101, 201, the threading shaft 11 is placed at a position at which the threading hook 20 carries out a threading with respect to the needle 2.

(3) In a third state in which the moving operation dial 401 is adjusted to a position at which the engaging projection of the leaf spring 417 engages with the engaging concave portion 414, the projection 423*a* is placed at a third position of FIG. 9A in the cam groove 421*a* of the first cam 421, and the first frame member 101 is leftwardly moved. Moreover, the follower projection 433 is placed at a third position of FIG. 9B in the slot 431*b* of the second cam 431, and the second frame member 201 is moved toward a front side. At this time, a moving distance of the first frame member 101 is coincident with an interval between the needles 2, 3 in the X-axis direction, and a moving distance of the second frame member 201 is coincident with an interval between the needles 2, 3 in the Y-axis direction. According to this arrangement of the first and second frame members 101, 201, the threading shaft 11 is placed at a position at which the threading hook 20 carries out a threading with respect to the needle 3.

(4) In a fourth state in which the moving operation dial 401 is adjusted to a position at which the engaging projection of the leaf spring 417 engages with the engaging concave portion 415, the projection 423*a* is placed at a fourth position of FIG. 9A in the cam groove 421*a* of the first cam 421, and the first frame member 101 is leftwardly moved. Moreover, the follower projection 433 is placed at a fourth position of FIG. 9B in the slot 431*b* of the second cam 431, and the second frame member 201 does not move from the third state. At this time, a moving distance of the first frame member 101 is coincident with an interval between the needles 3, 4 in the X-axis direction. According to this arrangement of the first and second frame members 101, 201, the threading shaft 11 is placed at a position at which the threading hook 20 carries out a threading with respect to the needle 4.

(5) In a fifth state in which the moving operation dial 401 is adjusted to a position at which the engaging projection of the leaf spring 417 engages with the engaging concave portion 416, the projection 423*a* is placed at a fifth position of FIG. 9A in the cam groove 421*a* of the first cam 421, and the first frame member 101 is leftwardly moved. Moreover, the follower projection 433 is placed at a fifth position of FIG. 9B in the slot 431*b* of the second cam 431, and the second frame member 201 does not move from the third state. At this time, a moving distance of the first frame member 101 is coincident with an interval between the needles 4, 5 in the X-axis direction. According to this arrangement of the first and second frame members 101, 201, the threading shaft 11 is placed at a position at which the threading hook 20 carries out a threading with respect to the needle 5.

By carrying out the position switching operation of the moving operation dial 401 in order from the first state to the fifth state as described in (1) to (5), the threading shaft 11 is placed at the positions at which the threading hook 20 can implement threading with respect to the respective needles 1 to 5. Thus, it is possible to insert the thread into each of the needles 1 to 5. The respective members 95*a*, 101, 102, 201, 202, 203*a* serves as a coupling mechanism which combines the movements in the first and second directions through the first and second cam mechanisms 420, 430 in accordance with the operation of the moving operation dial 401.

Threading Operation Inputting Mechanism—Overall Configuration

The threading operation inputting mechanism 300 will be described with reference to FIGS. 2, 3 and 10 to 14.

The threading operation inputting mechanism 300 includes an operation lever 310 (threading operation inputting means) for moving the threading shaft 11 downward, thereby inputting a threading operation, a threading slide guide 320 (an up-down frame member) for carrying out a downward moving operation together with the threading shaft 11 through a downward inputting operation from the operation lever 310, a height regulating mechanism 330 for blocking the downward movement of the threading shaft 11 in a plurality of heights corresponding to the heights of the eyes of the needles 1 to 5, and a threading cam mechanism 340 for rotating the threading shaft 11 in a direction in which the threading hook 20 is moved forward when only the threading slide guide 320 is moved downward with respect to the threading shaft 11.

Threading Operation Inputting Mechanism—Threading Slide Guide The threading slide guide 320 includes a back plate 321 which is vertically long and takes an arcuate section, plate-shaped support portions 322, 323 provided integrally with both upper and lower ends of the back plate 321 and having through holes in which the threading shaft 11 is to be inserted, and an engaging shaft 324 with the operation lever 310 which is extended leftward in the X-axis direction from the back plate 321.

The support portions 322, 323 are plate-shaped along an X-Y plane and are provided with the through holes for inserting the threading shaft 11 therethrough, and the threading slide guide 320 is coupled to the threading shaft 11 slidably along the threading shaft 11 via the through holes. A compression coil spring 325 is inserted between the upper support portion 322 and a first guide pin 331 provided on the threading shaft which will be described below, and a stopper 11*a* for abutting on an upper surface of the support portion 322 is provided on an upper end of the threading shaft 11. Therefore, the threading shaft 11 and the threading slide guide 320 are always energized such that the threading shaft 11 is pressed downward and the threading slide guide 320 is pressed upward.

Threading Operation Inputting Mechanism—Operation Lever

Figure 10:
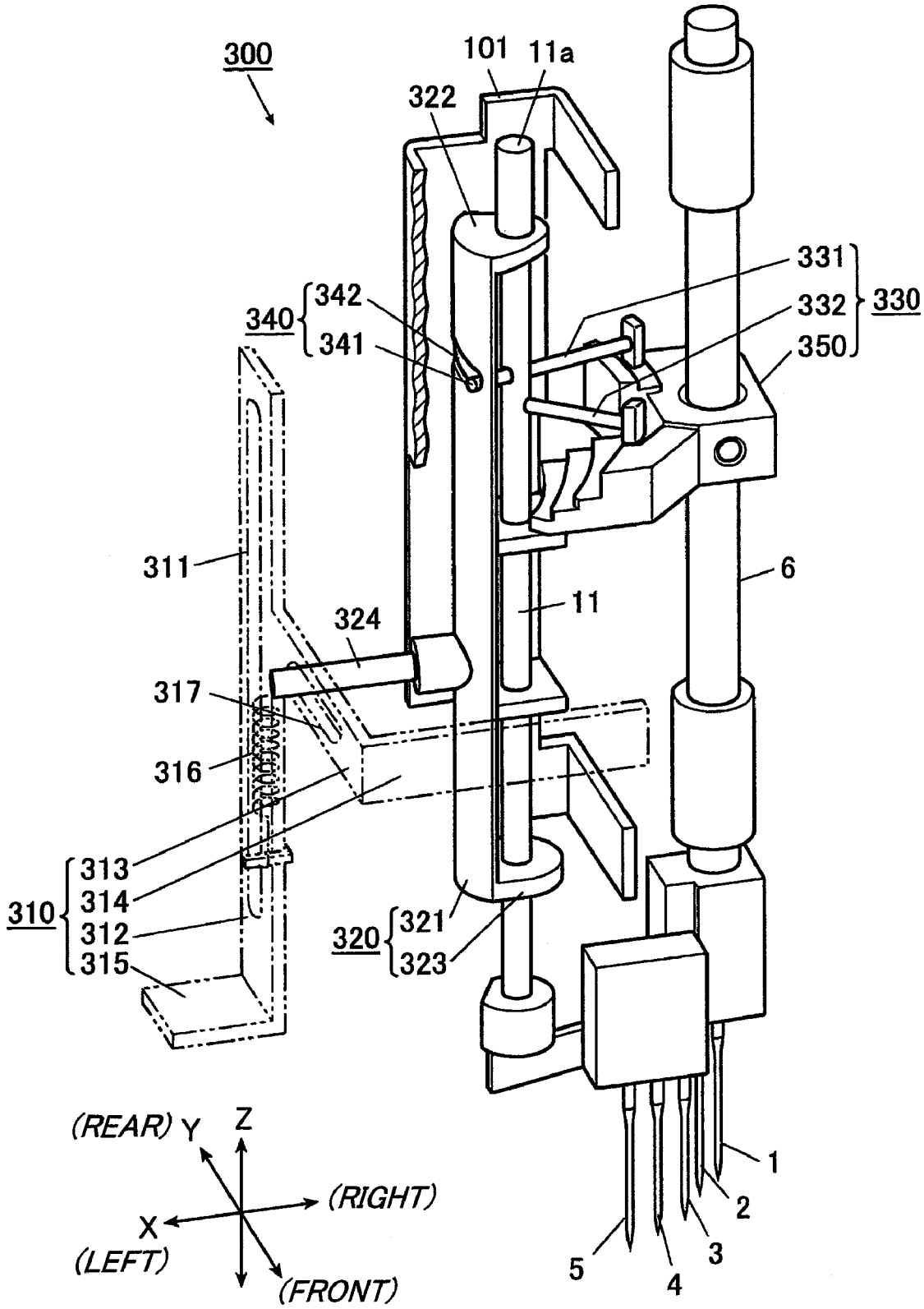
FIG. 10 is a perspective view of a threading operation inputting mechanism.
Figure 11:
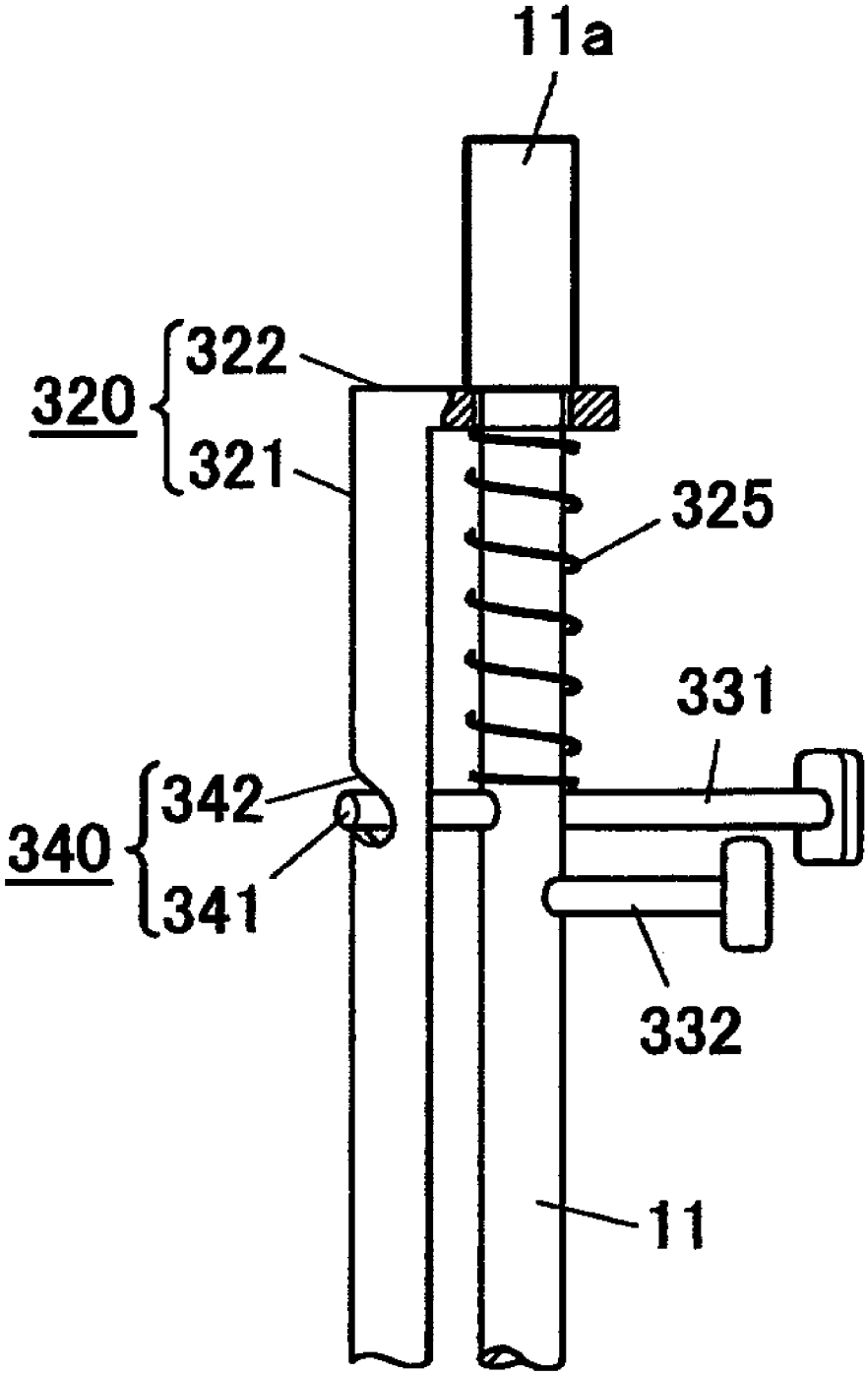
FIG. 11 is an explanatory view of a portion of a threading cam mechanism.
Figure 12:
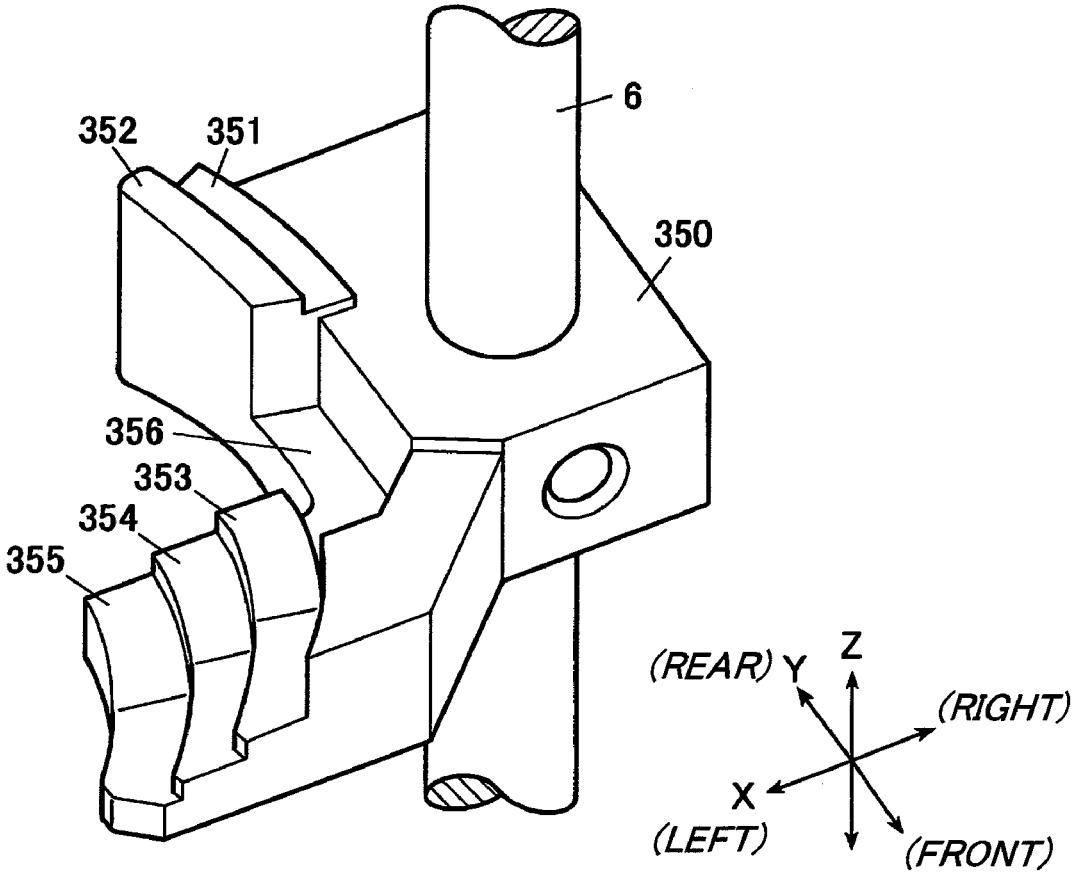
FIG. 12 is a perspective view of a lower threading guide.

As shown in FIGS. 3 and 10, the operation lever 310 is provided on a left side surface of the left sidewall portion 94 of the main frame 90 and is provided with a slot 311 in a vertical direction which serves to insert two guide shafts 96 protruded leftward in upper and lower positions of the left side surface of the left sidewall portion 94, and is held by a C ring 97 provided in a tip portion of each of the guide shafts 96 so as not to slip off. The operation lever 310 is supported to be vertically movable with respect to the main frame 90 through the structure.

The operation lever 310 includes a long body portion 312 in a vertical direction, an arm portion 313 extended in an orthogonal direction to the body portion 312 (the Y-axis direction) in the vicinity of a middle of the body portion 312, and a thread holder operating portion 314 bent at a right angle in a tip part of the arm portion 313 and extended in the X-axis direction.

The body portion 312 has the slot 311 formed to penetrate therethrough. Moreover, an input portion 315 bent at a right angle and extended in the X-axis direction is formed on a lower end of the body portion 312, and a downward pressing operation is input therefrom. Furthermore, the body portion 312 is coupled to the main frame 90 through a tension spring 316 and an upward tensile force is always energized.

On the other hand, the arm portion 313 is provided with a slot 317 to penetrate in the Y-axis direction and the engaging shaft 324 extended from the threading slide guide 320 is inserted therein. Accordingly, the downward moving operation input through the operation lever 310 is transmitted from the arm portion 313 to the threading slide guide 320 and the threading shaft 11 through the engaging shaft 324. The slot 317 of the arm portion 313 is provided in the Y-axis direction in order to permit a movement in the Y-axis direction through the second supporting mechanism 200.

The thread holder operating portion 314 serves to apply an operation for moving the thread holder 50 close to the needle side in the forward movement of the threading hook 20. By providing the thread holder operating portion 314 in the operation lever 310, it is possible to implement the forward moving operation of the threading hook 20 and the close motion of the thread holder 50 which are interlocked with each other. An action of the thread holder operating portion 314 on the thread holder 50 will be described in detail in explanation of the thread holder supporting mechanism 60.

Threading Operation Inputting Mechanism—Threading Cam Mechanism

The threading cam mechanism 340 includes an engaging projection 341 protruded in a horizontal direction from the threading shaft 11 toward the back plate 321 of the threading slide guide 320, and a slot portion 342 (a groove cam) which is formed on the back plate 321 of the threading slide guide 320.

The engaging projection 341 actually serves as a rear end of the first guide pin 331 to be described below which penetrates through the threading shaft 11. The engaging projection 341 is set to have such a length as to be inserted into the slot portion 342 penetrating through the back plate 321 and to penetrate to an outside of the back plate 321.

A longitudinal direction of the slot portion 342 is tilted with respect to the vertical direction. The engaging projection 341 maintains a state in which it is usually positioned on a lower end of the slot portion 342 by the action of the compression coil spring 325 provided between the threading shaft 11 and the threading slide guide 320. The slot portion 342 is tilted in such a direction as to generate a displacement in a direction in which the threading shaft 11 is rotated in the forward moving direction of the threading hook 20 when the engaging projection 341 is lifted along the slot portion 342. More specifically, the threading shaft 11 is rotated clockwise when seen in a plan view so that the threading hook 20 is moved forward. Thus, the slot portion 342 is tilted upward in a direction turned toward a back side in the Y-axis direction.

In a case in which the threading slide guide 320 is relatively moved downward with respect to the threading shaft 11, the engaging projection 341 is moved upward along the slot portion 342. As described above, by the action of the compression coil spring 325 provided between the threading shaft 11 and the threading slide guide 320 and the stopper 11*a* provided on the upper end of the threading shaft 11, the threading shaft 11 and the threading slide guide 320 carry out a vertical motion together until a greater force than a pressing force of the compression coil spring 325 is applied. Accordingly, the height regulating mechanism 330 for blocking the downward movement of the threading shaft 11 is provided in the middle of a downward moving path thereof, and blocks the downward movement of only the threading shaft 11 in the middle when a downward moving operation is input to the threading slide guide 320 and the threading shaft 11 through the operation lever 310. In this case, when a greater pressing force than that of the compression coil spring 325 is input from the operation lever 310, the threading slide guide 320 is relatively moved downward with respect to the threading shaft 11 and the threading shaft 11 is rotated by the action of the threading cam mechanism 340 so that the threading hook 20 is moved forward to carry out a threading work. The threading hook 20 is moved backward by a return force of the compression coil spring 325 by releasing the operation lever 310.

Threading Operation Inputting Mechanism—Height Regulating Mechanism

The height regulating mechanism 330 has a function for blocking the downward movement of only the threading shaft 11 in order to operate the threading cam mechanism 340 and a function for regulating a height of the threading hook 20 for each of the needles 1 to 5 in cooperation with the positioning mechanism 400 for moving and positioning the threading shaft 11 corresponding to an arrangement of the needle in the threading work of each of the needles 1 to 5.

More specifically, the height regulating mechanism 330 for defining a position in the Z-axis direction (the vertical direction) of the threading shaft 11 includes the first guide pin 331 and a second guide pin 332 which are provided on the threading shaft 11, a lower threading guide 350 including five abutting portions 351 to 355 on which either of the guide pins 331, 332 abuts from above, and an upper threading guide 360 (which is not shown in FIG. 10) for guiding a revolution of each of the guide pins 331, 332 in the rotation of the threading shaft 11.

Both of the first and second guide pins 331, 332 are provided perpendicularly to the threading shaft 11, and the first guide pin 331 is disposed in an upper part. Moreover, the two guide pins 331, 332 are disposed on the threading shaft 11 at different angles around the threading shaft 11 over the X-Y plane.

The lower threading guide 350 is a block-shaped member which is fixed and supported on the needle bar 6 and includes the five abutting portions 351 to 355 in an upper part.

Figure 13A:
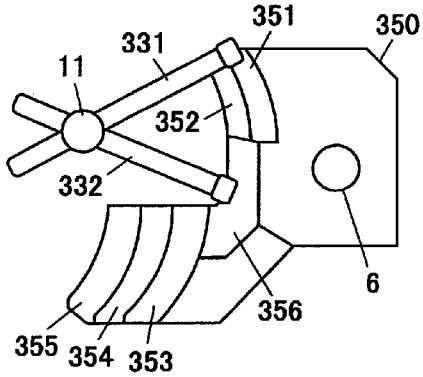
FIGS. 13A to 13E are explanatory views showing a relationship between guide pins and abutting portions when a threading shaft is positioned by a positioning mechanism so as to correspond to respective needles.
Figure 13D:
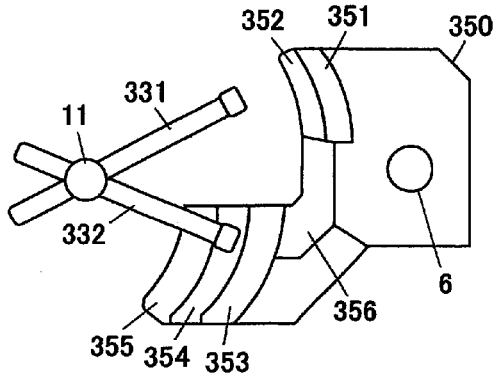
Figure 13B:
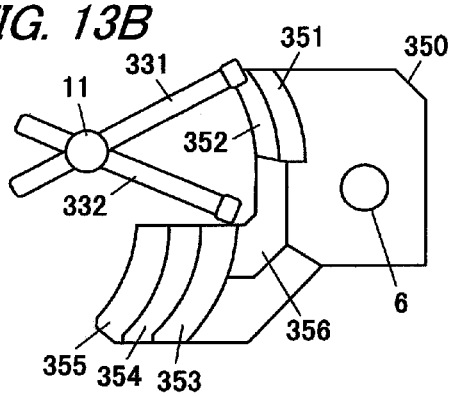
Figure 13E:
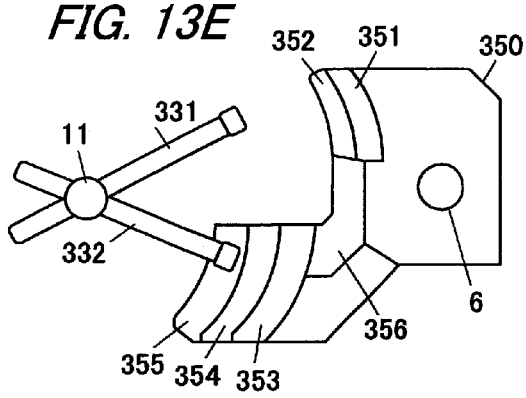
Figure 13C:
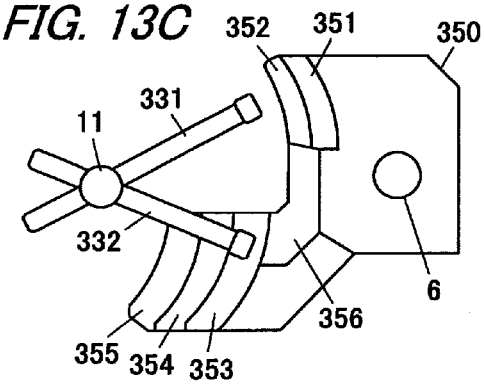
Figure 13C:
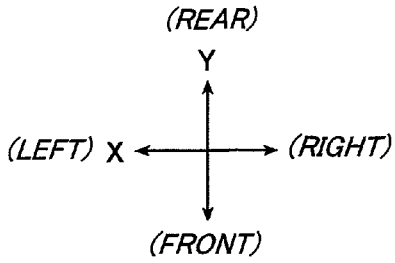

The abutting portion 351 is arranged such that the first guide pin 331 is moved downward to abut thereon when the threading shaft 11 is placed in a position in which the thread is to be inserted into the needle 1 as shown in FIG. 13A, the abutting portion 352 is arranged such that the first guide pin 331 is moved downward to abut thereon when the threading shaft 11 is placed in a position in which the thread is to be inserted into the needle 2 as shown in FIG. 13B, the abutting portion 353 is arranged such that the second guide pin 332 is moved downward to abut thereon when the threading shaft 11 is placed in a position in which the thread is to be inserted into the needle 3 as shown in FIG. 13C, the abutting portion 354 is arranged such that the second guide pin 332 is moved downward to abut thereon when the threading shaft 11 is placed in a position in which the thread is to be inserted into the needle 4 as shown in FIG. 13D, and the abutting portion 355 is arranged such that the second guide pin 332 is moved downward to abut thereon when the threading shaft 11 is placed in a position in which the thread is to be inserted into the needle 5 as shown in FIG. 13E.

Moreover, surfaces of the respective abutting portions 351 to 355 are formed to be substantially arcuate such that each of the guide pins 331, 332 can maintain an abutting state when the threading shaft 11 abuts to carry out a rotation.

Furthermore, each of the abutting portions 351 to 355 serves to determine the heights of the threading shaft 11 and the threading hook 20 in the threading work. Accordingly, heights of the surfaces of the respective abutting portions 351 to 355 are set differently from each other so as to correspond to the heights of the eyes of the respective needles 1 to 5.

In addition, the abutting portions 351, 352 and the abutting portions 353, 354, 355 are disposed apart from each other depending on an opening angle around the threading shaft 11 in the guide pins 331, 332. Thus, a plurality of abutting portions is distributed and disposed corresponding to the number of the guide pins, thereby avoiding an interference from the arrangements of the respective abutting portions.

Although two guide pins 331, 332 are provided, moreover, a difference is provided between the heights of the first guide pin 331 and the second guide pin 332 such that one of them does not abut on any of the abutting portions when the other abuts on the abutting portion. Furthermore, a relief portion 356 is formed to be partially lower than an upper surface such that one of the guide pins does not abut on a portion other than the abutting portion of the lower threading guide 350 when the other guide pin abuts on the abutting portion (see FIG. 13A).

Since the lower threading guide 350 has a function for determining the height of the threading hook 20 in the threading work, it is required to always have a height in a certain section. Accordingly, a sewing machine motor is controlled to have an upper shaft angle in a predetermined certain section such that the needle bar is always placed in the same threading enable section in the threading work.

Figure 14:
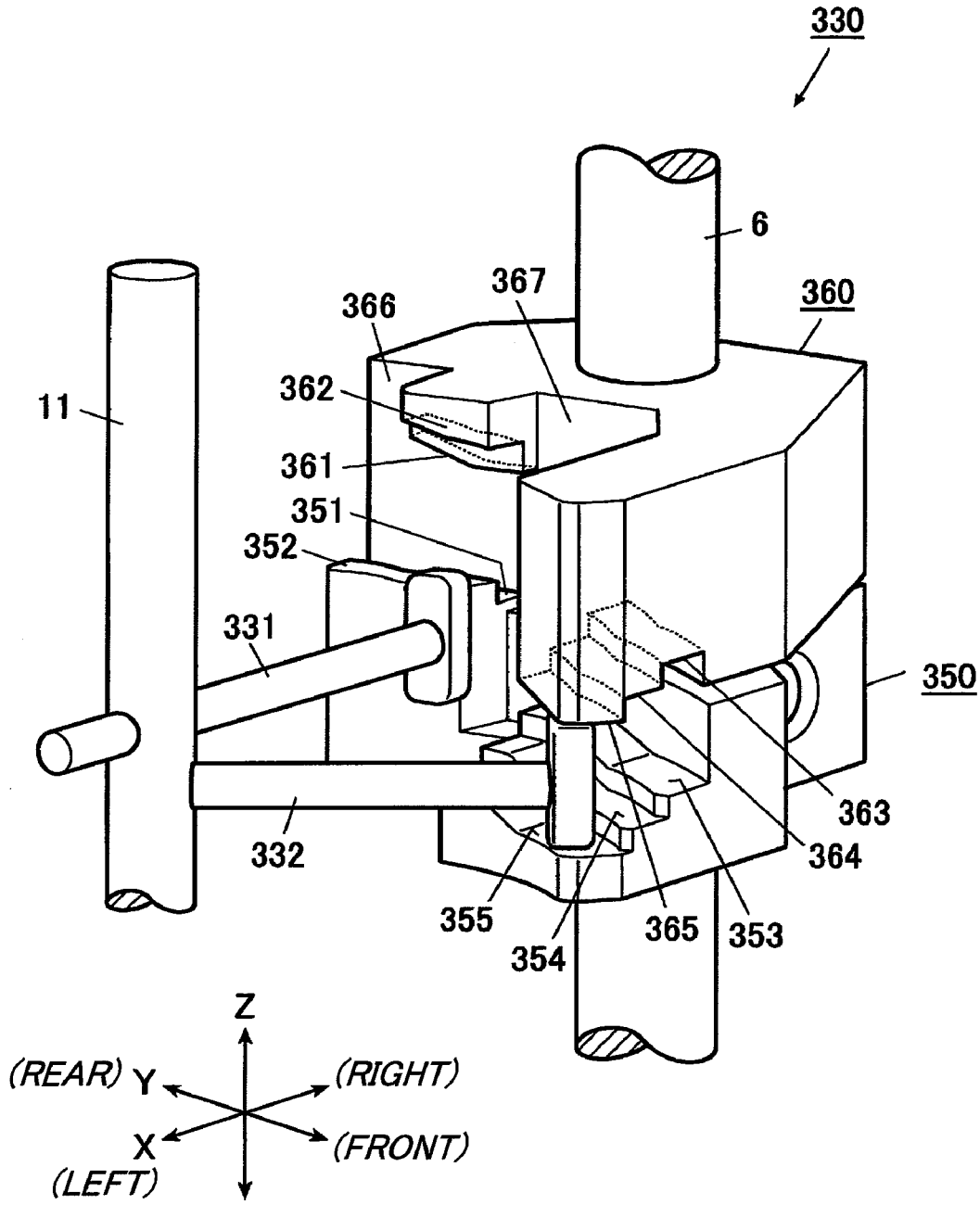
FIG. 14 is an enlarged perspective view of the lower threading guide and an upper threading guide.

FIG. 14 is an enlarged perspective view showing the lower threading guide 350 and the upper threading guide 360.

The upper threading guide 360 has a function for abutting from above to guide either of the guide pins 331, 332 in order to maintain an abutment when the guide pin 331 or 332 abutting on each of the abutting portions 351 to 355 of the lower threading guide 350 is moved over the upper surface of each of the abutting portions 351 to 355 through the rotation of the threading shaft 11.

As shown in FIG. 14, accordingly, the upper threading guide 360 includes a guide portion 361 for abutting to guide the first guide pin 331 when the first guide pin 331 is moved in abutment on the abutting portion 351 of the lower threading guide 350, a guide portion 362 for abutting to guide the first guide pin 331 when the first guide pin 331 is moved in abutment on the abutting portion 352, a guide portion 363 for abutting to guide the second guide pin 332 when the second guide pin 332 is moved in abutment on the abutting portion 353, a guide portion 364 for abutting to guide the second guide pin 332 when the second guide pin 332 is moved in abutment on the abutting portion 354, a guide portion 365 for abutting to guide the second guide pin 332 when the second guide pin 332 is moved in abutment on the abutting portion 355, a relief portion 366 for permitting the downward movement of the first guide pin 331 in the downward movement of the threading shaft 11, and a relief portion 367 for permitting the downward movement of the second guide pin 332 in the downward movement of the threading shaft 11.

Thread Holder

The thread holder 50 is formed by bending a thin plate, and includes two thread passing portions 51 and 52 for guarding a thread at lower ends, and an interposing portion 53 having a leaf spring which serves to interpose a thread end as shown in FIG. 2. The two thread passing portions 51 and 52 have notches (not shown) for guarding the thread respectively and the thread is provided thereover and can be thus laid in the X-axis direction. Moreover, the interposing portion 53 has a holding plate and the leaf spring coming in pressure contact with each other and can insert and interpose the thread end therebetween. Furthermore, the interposing portion 53 is provided adjacently in an arranging direction of the two thread passing portions 51 and 52 and can maintain a state in which the thread is stretched in the X-axis direction between the two thread passing portions 51 and 52 by causing the interposing portion 53 to interpose a residual end of the thread in the case in which the thread guarding is carried out with the thread laid between the two thread guarding portions 51 and 52.

By disposing the thread holder 50 on an opposite side to the threading hook 20 with the thread interposed therebetween in a state in which the thread is stretched in the X-axis direction, thus, it is possible to smoothly catch the thread by the bent part in a rearward movement of the threading hook 20 when the threading hook 20 moved forward in the Y-axis direction passes just above the thread which is orthogonal thereto.

Thread Holder Supporting Mechanism

As shown in FIGS. 2 and 4, the thread holder supporting mechanism 60 includes the moving member 61 to be moved through the guide grooves 106*a*, 106*b* of the front sidewall portion 106 while oscillatably holding the thread holder 50, an interlocking member 62 for moving the moving member 61 downward with the downward movement of the threading shaft 11, and an oscillating lever 63 for oscillating the thread holder 50 placed in a threading position toward the needle side.

The moving member 61 is a long plate and is disposed in a vertical direction, and has guide shafts 64 and 64 provided in two places in an upper part thereof. The respective guide shafts 64 and 64 are inserted into the guide grooves 106*a*, 106*b* of the front sidewall portion 106 respectively and are fixed through a C ring 65 at a front side. By the structure, the moving member 61 can be moved along the guide grooves 106*a*, 106*b*. A position of the thread holder 50 in the case in which the moving member 61 is positioned on upper ends of the guide grooves 106*a*, 106*b* is defined as a standby position, and a position of the thread holder 50 in the case in which the moving member 61 is positioned on lower ends of the guide grooves 106*a*, 106*b* is defined as a threading position.

A boss-shaped projection 61*b* is provided on a back side at an upper end of the moving member 61, and the interlocking member 62 for carrying out an up-down movement together with the threading shaft 11 abuts thereon from above.

Furthermore, the moving member 61 has a lower part bent at a right angle to include a plane portion 61*a* provided along the Y-Z plane and pivotally supports the thread holder 50 through a support shaft in the X-axis direction at a lower end of the plane portion 61*a*. Moreover, the oscillating lever 63 is pivotally supported through a support shaft in the X-axis direction in an upper part of the same plane portion 61*a*.

The thread holder 50 has an abutting portion 54 on the oscillating lever 63 above the support shaft.

On the other hand, the oscillating lever 63 has an oscillating portion 63*a* suspended downward, and the oscillating portion 63*a* is provided with a projection 63*b*. The projection 63*b* abuts on the abutting portion 54 of the thread holder 50 from a back side. Moreover, the oscillating lever 63 has an upper back side provided with an engaging extended portion 63*c* on which the thread holder operating portion 314 of the operation lever 310 abuts from above. When the thread holder operating portion 314 of the operation lever 310 abuts on the engaging extended portion 63*c* from above, the oscillating portion 63*a* of the oscillating lever 63 is oscillated and the projection 63*b* presses the abutting portion 54 of the thread holder 50 toward a front side, thereby oscillating the thread holder 50. By the oscillation, the thread passing portions 51 and 52 provided on the lower end of the thread holder 50 approach the needle 1 to 5 sides, thereby enabling a transfer of the thread to the threading hook 20.

The moving member 61 of the thread holder supporting mechanism 60 is moved downward interlockingly with the threading shaft 11 through the interlocking member 62. When the threading shaft 11 is regulated to have a proper height through each of the abutting portions 351 to 355 of the lower threading guide 350, therefore, the thread holder 50 can also be regulated to have a proper height through the moving member 61.

Operation of Threading Device

Next, description will be given to the threading operation according to the threading device 10 having the configuration described above.

First of all, the needles 1 to 5 for carrying out the threading work are selected by the rotating operation of the moving operation dial 401.

At this time, the first cam mechanism 420 moves the first frame member 101 of the first supporting mechanism 100 in the X-axis direction depending on an angle position of the moving operation dial 401, and the second cam mechanism 430 moves the second frame member 201 of the second supporting mechanism 200 in the Y-axis direction. In their cooperation, the threading shaft 11 is moved and placed at a certain position in the X-Y plane.

In the height regulating mechanism 330, it is determined as to which guide pin 331 or 332 abuts on which of the abutting portions 351 to 355.

When the operation lever 310 is operated downward, then, the threading shaft 11 starts a downward moving operation together with the threading slide guide 320. Moreover, the moving member 61 is pressed downward through the interlocking member 62 provided on the upper end of the threading shaft 11 so that the thread holder 50 also starts a downward moving operation.

When the predetermined guide pins 331, 332 extended from the threading shaft 11 abut on the predetermined abutting portions 351 to 355, thereafter, the downward moving operation is blocked so that the threading shaft 11 and the threading hook 20 are regulated to have a height of the selected needle depending on the set heights of the abutting portions 351 to 355. Moreover, the thread holder 50 interlocked through the interlocking member 62 is also regulated to have the height of the selected needle.

At this time, when the operation lever 310 is further pressed downward, only the threading slide guide 320 is moved downward with respect to the threading shaft 11. As a result, the threading shaft 11 is rotated clockwise by the action of the threading cam mechanism 340. Moreover, the thread holder operating portion 314 of the operation lever 310 presses the oscillating portion 63*c* of the oscillating lever 63 from above to rotate the oscillating lever 63. As a result, the threading hook 20 is moved forward and is thus inserted into the eye of the predetermined needle so that the thread holder 50 is tilted toward the needle side to cause the thread stretched in the X-axis direction to approach the front surface of the threading hook 20. As a result, the bent part of the threading hook 20 catches the thread.

When the operation lever 310 is released from the downward pressing state, subsequently, the threading hook 20 starts a rearward movement to pull the caught thread into the eye of the needle so that the threading work is executed.

In the case in which the thread is inserted into another needle, furthermore, the moving operation dial 401 is rotated to manipulate the operation lever 310 downward again.

Advantages of Threading Device

The threading device 10 supports the threading shaft 11 movably into an optional position over the X-Y plane through the first supporting mechanism 100 and the second supporting mechanism 200, and the positioning mechanism 400 selectively carries out a moving and positioning operation into five places corresponding to the respective needles 1 to 5 depending on the rotating operation of the moving operation dial 401 in cooperation of the two cam mechanisms 420 and 430.

Accordingly, even in a case, like in a sewing machine operable to implement a overlock stitch and a cover stitch for example, where the five needles 1 to 5 are mounted and are not disposed simply, for example not in a line, it is not necessary to input an individual position adjusting operation in a plurality of directions but it is possible to position the threading shaft 11 through only the rotating operation of the moving operation dial 401, and furthermore, to carry out an alignment with all of the needles 1 to 5 in order. Accordingly, it is possible to precisely insert the thread into all of the needles 1 to 5.

Moreover, the thread holder 50 is provided on the first frame member 101 through the moving member 61. Therefore, the thread holder 50 as well as the threading shaft 11 can be aligned with all of the needles 1 to 5 in order with respect to the X-Y direction through only the rotating operation of the moving operation dial 401, and furthermore, the thread can be precisely inserted into all of the needles 1 to 5.

In the threading device 10, moreover, the abutting portions 351 to 355 of the lower threading guide 350 in the threading operation inputting mechanism 300 have the heights set corresponding to the needles 1 to 5 individually. Therefore, it is possible to adjust the threading hook 20 to have a proper height for the eyes of the needles 1 to 5.

Even when the five needles 1 to 5 are mounted, as in the sewing machine operable implement an overlock stitch and a cover stitch, it is possible to distribute and provide the respective abutting portions 351 to 355 on the lower threading guide 350 because the two guide pins 331, 332 are provided. Thus, it is possible to properly regulate the height of the threading hook 20, thereby carrying out the threading work further appropriately.

Other Exemplary Embodiments

According to another exemplary embodiment of the present invention, the number of the guide pins provided on the threading shaft 11 may be three or more.

Moreover, according to another exemplary embodiment of the present invention, the respective needles may be arranged at positions that are two-dimensionally different from each other in horizontal directions while heightwise position being equal to each other.

Figure 15A:
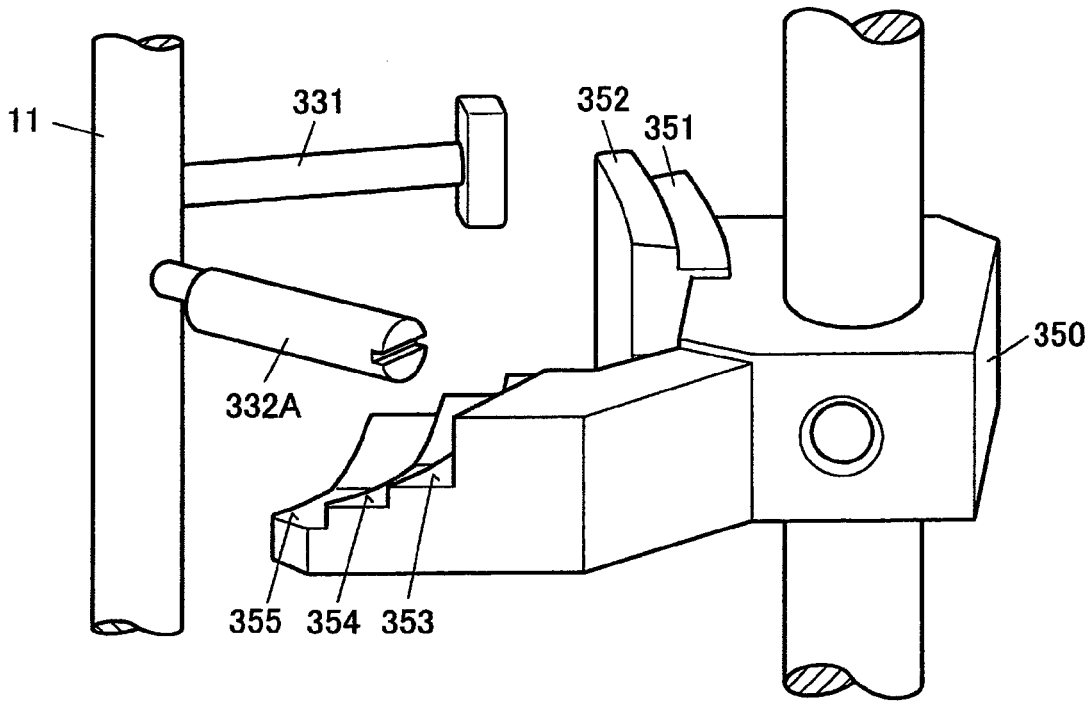
FIG. 15A is a perspective view showing another exemplary embodiment in which an eccentric pin is used as a guide pin.

Furthermore, according to another exemplary embodiment of the present invention, a shaft member having a structure including an eccentric shaft may be used for at least one of the guide pins 331, 332. FIG. 15A shows an example in which the second guide pin 332 is exchanged to an eccentric pin 332A.

Figure 15B:
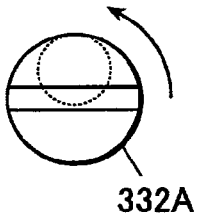
FIG. 15B is a view showing a state before a height adjustment by the eccentric pin.
Figure 15C:
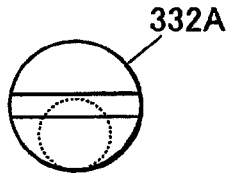
FIG. 15C is a view showing a state after the height adjustment by the eccentric pin.

Referring to the eccentric pin 332A, a height of a lower surface to abut on each of the abutting portions 351 to 355 can be changed through a rotating adjustment as shown in FIGS. 15B and 15C. For example, in a case in which a difference in a height is made between the needles 1, 2 used for the overlock stitch and the needles 3, 4, 5 used for the cover stitch, it is possible to quickly carry out an adjustment and an adaptation thereto.

While description has been made in connection with exemplary embodiments of the present invention, those skilled in the art will understand that various changes and modification may be made therein without departing from the present invention. It is aimed, therefore, to cover in the appended claims all such changes and modifications falling within the true spirit and scope of the present invention.

What is claimed is:

1. A threading device of a sewing machine having at least three needles which are two-dimensionally arranged in horizontal directions, wherein the threading device is operable to thread the respective needles, the threading device comprising:

a threading hook operable to insert a thread into an eye of each of the needles by entering the eye by a forward movement and catching the thread by a rearward movement;

a threading shaft holding the threading hook;

a threading operation inputting mechanism from which a thread inserting movement is given to the threading hook via the threading shaft;

a first supporting mechanism supporting the threading shaft so as to be movable in a first direction in a horizontal plane;

a second supporting mechanism supporting the threading shaft so as to be movable in a second direction in the in horizontal plane; and a positioning mechanism which, when operated, moves the threading shaft along a path corresponding to an arrangement of each of the needles, wherein the positioning mechanism comprises:

a movement operating portion which, when operated, carries out a positional switching toward the respective needles;

a first cam mechanism from which a movement in the first direction is given to the threading shaft in accordance with an operation of the movement operating portion;

a second cam mechanism from which a movement in the second direction is given to the threading shaft in accordance with the operation of the movement operating portion; and a coupling mechanism operable to combine the movements in the first and second directions from the first and second cam mechanisms and to transmit the combined movements to the threading shaft in accordance with the operation of the movement operating portion, wherein the threading shaft is sequentially moved to positions corresponding to the arrangement of each of the needles in the horizontal directions in accordance with the operation of the movement operating portion.

2. The threading device according to claim 1, further comprising a thread holder operable to hold the thread on a side of the needles opposite to the threading hook, and a frame member to which the thread holder and the threading shaft are attached such that the frame member to which the thread holder are movable together.

3. A threading device of a sewing machine having at least three needles which are two-dimensionally arranged in horizontal directions, wherein the threading device is operable to thread the respective needles, the threading device comprising:

a threading hook operable to insert a thread into an eye of each of the needles by entering the eye by a forward movement and catching the thread by a rearward movement;

a threading shaft which is supported so as to be movable in a vertical direction and rotatable, and holding the threading hook at a lower end portion thereof;

an operation lever coupled to the threading shaft so as to be operable to move the threading shaft in the vertical direction;

a movement operating portion disposed so as to be manually operable to switch a position of the threading shaft with respect to each of the needles;

a first cam which provides, when the movement operating portion is operated, a displacement in a first direction in a horizontal plane to the threading shaft;

a second cam which provides, when the movement operating portion is operated, a displacement in a second direction in the horizontal plane to the threading shaft;

a first frame member coupled to the first cam so as to be movable in the first direction in the horizontal plane by following the first cam;

a second frame member coupled to the second cam so as to move the first frame member in the second direction, which is orthogonal to the first direction in the horizontal plane, by following the second cam; and a coupling mechanism which, when the movement operating portion is operated, combines the displacements in the first and second directions of the first and second frame members from the first and second cams, and transmits the combined displacements to the threading shaft, wherein the threading shaft is sequentially moved to positions corresponding to an arrangement of each of the needles in the horizontal directions.

* * * * *